US009470405B2

(12) United States Patent
Boccoleri et al.

(10) Patent No.: US 9,470,405 B2
(45) Date of Patent: Oct. 18, 2016

(54) SURGICAL LIGHT WITH BEAM REDIRECTING OPTICS

(71) Applicants: Gianni R. Boccoleri, Lantana, TX (US); Robert L. York, Lantana, TX (US); James K. Alexanderson, Coppell, TX (US); Reno B. Lauro, Garland, TX (US); Wojciech K. Timoszyk, Flower Mound, TX (US)

(72) Inventors: Gianni R. Boccoleri, Lantana, TX (US); Robert L. York, Lantana, TX (US); James K. Alexanderson, Coppell, TX (US); Reno B. Lauro, Garland, TX (US); Wojciech K. Timoszyk, Flower Mound, TX (US)

(73) Assignee: STRYKER CORPORATION, Kalamazoo, MI (US)

( * ) Notice: Subject to any disclaimer, the term of this patent is extended or adjusted under 35 U.S.C. 154(b) by 107 days.

(21) Appl. No.: 14/198,805

(22) Filed: Mar. 6, 2014

(65) Prior Publication Data

US 2014/0268751 A1 Sep. 18, 2014

Related U.S. Application Data

(60) Provisional application No. 61/790,892, filed on Mar. 15, 2013.

(51) Int. Cl.

| | |
|---|---|
| ***F21V 21/40*** | (2006.01) |
| ***F21V 5/00*** | (2015.01) |
| *F21V 5/04* | (2006.01) |
| *F21W 131/205* | (2006.01) |

(52) U.S. Cl.

CPC ..... *F21V 21/40* (2013.01); *F21V 5/008* (2013.01); *F21V 5/04* (2013.01); *F21W 2131/205* (2013.01); *F21Y 2105/10* (2016.08); *F21Y 2115/10* (2016.08)

(58) Field of Classification Search

CPC ..... F21K 9/50; F21V 29/22; F21V 5/008; F21V 5/007; F21V 5/04; F21V 21/40; F21V 13/00; F21V 13/02; F21V 13/04; F21Y 2105/001; F21W 2131/205; F21W 2131/20

See application file for complete search history.

(56) References Cited

U.S. PATENT DOCUMENTS

| | | | | |
|---|---|---|---|---|
| 5,128,848 | A | 7/1992 | Enders et al. | |
| 5,820,253 | A | 10/1998 | Scholz | |
| 6,250,774 | B1 | 6/2001 | Begemann et al. | |
| 6,402,351 | B1 | 6/2002 | Borders et al. | |
| 6,644,837 | B2 | 11/2003 | Borders et al. | |
| 6,692,141 | B2 | 2/2004 | Jesurun et al. | |
| 6,863,417 | B2 | 3/2005 | Hill | |
| 6,863,422 | B2 | 3/2005 | Jesurun et al. | |
| 7,207,694 | B1 * | 4/2007 | Petrick | F21V 5/048 362/240 |
| 7,562,999 | B2 * | 7/2009 | Chen | F21V 5/048 362/239 |
| 7,701,151 | B2 | 4/2010 | Petrucci et al. | |
| 7,812,551 | B2 | 10/2010 | Hite et al. | |
| 7,857,619 | B2 | 12/2010 | Liu | |

(Continued)

*Primary Examiner* — Bao Q Truong

(74) *Attorney, Agent, or Firm* — Flynn, Thiel, Boutell & Tanis, P.C.

(57) ABSTRACT

A surgical light including a substrate having a substantially planar top surface with a plurality of light sources on the substantially planar top surface, with each of the light sources emitting light in a cone when activated. The cone has a first spread angle. An optical system having a first area such that the light emitted from the light sources has a second spread angle after passing through the first area and a second area focusing or redirecting the light passing through the first area at a location a desired distance from the optical system. The second spread angle is less than the first spread angle.

21 Claims, 24 Drawing Sheets

(56) References Cited

U.S. PATENT DOCUMENTS

| | | | | |
|---|---|---|---|---|
| 7,990,078 | B2 | 8/2011 | Petrucci et al. | |
| 8,172,751 | B2 | 5/2012 | Kusner et al. | |
| 8,292,804 | B2 * | 10/2012 | Marka | F21V 23/0464 600/249 |
| 8,317,361 | B2 * | 11/2012 | Lee | F21V 7/0008 362/218 |
| 2006/0039160 | A1 | 2/2006 | Cassarly et al. | |
| 2010/0053982 | A1 | 3/2010 | Klaus et al. | |
| 2012/0253138 | A1 | 10/2012 | Kusner et al. | |
| 2013/0258661 | A1 | 10/2013 | Jousse et al. | |

* cited by examiner

SURGICAL LIGHT WITH BEAM REDIRECTING OPTICS

CROSS REFERENCE TO RELATED APPLICATION

This application claims the benefit of U.S. Provisional Application Ser. No. 61/790,892, filed Mar. 15, 2013, which is incorporated herein by reference in its entirety.

FIELD OF THE INVENTION

The present invention relates to a surgical light, and in particular to a surgical light with beam redirecting optics.

BACKGROUND OF THE INVENTION

Surgical lights have been used in operating rooms to provide increased light to a specific area of the room. For example, the surgical light can be positioned within an operating room and can provide increased light to a specific area of a person being operated on within the operating room. In the past, surgical lights have had a cup shaped housing having a plurality of light sources therein, with the lights sources emitting light sidewardly and then reflected to a focus point. The cup shape of the housing allowed the light to be focused at a distance within an operating room. In some of the prior art surgical lights, each reflector and associated light source are moved as a unit to adjust a size of the light at the focus spot. In some other prior art surgical lights, an incandescent bulb is moved relative to the surrounding reflector to adjust the size of the light at the focus spot.

SUMMARY OF THE INVENTION

The present invention, according to one aspect, is directed to a surgical light comprising a substrate having a substantially planar top surface with a plurality of light sources on the substantially planar top surface, with each of the light sources emitting light when activated, and an optical system having a first area collimating the light emitted from the light sources and a second area focusing or redirecting the light passing through the first area at a location a desired distance from the optical system.

Another aspect of the present invention includes providing a surgical light comprising a movable arm and a light assembly connected to the movable arm. The light assembly comprises a housing, a substrate, at least one first optical element and at least one second optical element. The substrate is positioned within the housing, with the substrate having a substantially planar top surface with a plurality of LEDs on the substantially planar top surface. Each of the LEDs emit light when activated. The at least one first optical element is positioned adjacent the LEDs and has a first entrance and a first exit. The at least one first optical element receives the light emitted from the LEDs into the first entrance and passing the light therethrough. The light exiting the at least one first optical element at the first exit is collimated and substantially perpendicular to the substantially planar top surface of the substrate. The at least one second optical element is positioned adjacent the first exit of the at least one first optical element. The at least one second optical element has a second entrance receiving the light exiting the at least one first optical element. The light exits the at least one second optical element through a second exit of the at least one second optical element and is focused on or redirected to an area a desired distance from the second exit of the at least one second optical element.

Yet another aspect of the present invention is to provide a surgical light comprising a housing having a plurality of lighting subassemblies therein. Each of the lighting subassemblies comprises a substrate, a plurality of first optical elements and a second optical element. The substrate has a substantially planar top surface with a plurality of light sources on the substantially planar top surface. Each of the light sources emits light when activated. The plurality of first optical elements are positioned adjacent the light sources, with each first optical element having a first entrance adjacent one of the light sources and a first exit. The plurality of first optical element receive the light emitted from the light sources into the first entrances and pass the light therethrough. The light exiting the plurality of first optical element at the first exits are collimated and substantially perpendicular to the substantially planar top surface of the substrate. The second optical element is positioned adjacent the first exits of the plurality of first optical elements. The second optical element has a second entrance receiving the light exiting the plurality of first optical elements. The light exits the second optical element through a second exit of the second optical element and is focused on or redirected to a location a desired distance from the second exit of the second optical element.

Another aspect of the present invention is to provide a surgical light including a substrate having a substantially planar top surface with a plurality of light sources on the substantially planar top surface, with each of the light sources emitting light in a cone when activated. The cone has a first spread angle. The surgical light also includes an optical system having a first area such that the light emitted from the light sources has a second spread angle after passing through the first area and a second area focusing or redirecting the light passing through the first area at a location a desired distance from the optical system. The second spread angle is less than the first spread angle.

BRIEF DESCRIPTION OF THE DRAWINGS

One or more embodiments of the present invention are illustrated by way of example and should not be construed as being limited to the specific embodiments depicted in the accompanying drawings, in which like reference numerals indicate similar elements.

The specific devices and processes illustrated in the attached drawings, and described in the following specification are simply exemplary embodiments of the inventive concepts. Hence, specific dimensions and other physical characteristics relating to the embodiments disclosed herein are not to be considered as limiting.

DETAILED DESCRIPTION

The reference number 10 (FIG. 1) generally designates a surgical light of the present invention. The surgical light 10 is configured to be positioned within a room (e.g., operating room) and to provide increased light to a specific area of the room. While the surgical light 10 can be placed within an operating room, the surgical light 10 can also be placed in any area wherein targeted increased light is desired. The surgical light 10 includes a light assembly 12 and an arm 14 for connecting the light assembly 12 to a static or movable structure within the operating room. For example, the arm 14 can be directly connected to a suspension system connected to a wall or ceiling of the operating room, can be connected to a further arm assembly (not shown) or suspension system directly connected to a wall or ceiling of the operating room, or can be directly or indirectly connected to a movable assembly located within the operating room. For purposes of description herein, the terms "outer," "inner" and derivatives thereof shall relate to the surgical light 10 as orientated in FIG. 1. Furthermore, "upper," "lower" and derivatives thereof shall relate to the surgical light 10 as orientated in FIG. 2, with "upper" relating to the top of FIG. 2 and "lower" related to the bottom of FIG. 2. However, it is to be understood that the invention may assume various alternative orientations, except where expressly specified to the contrary.

Figure 1:
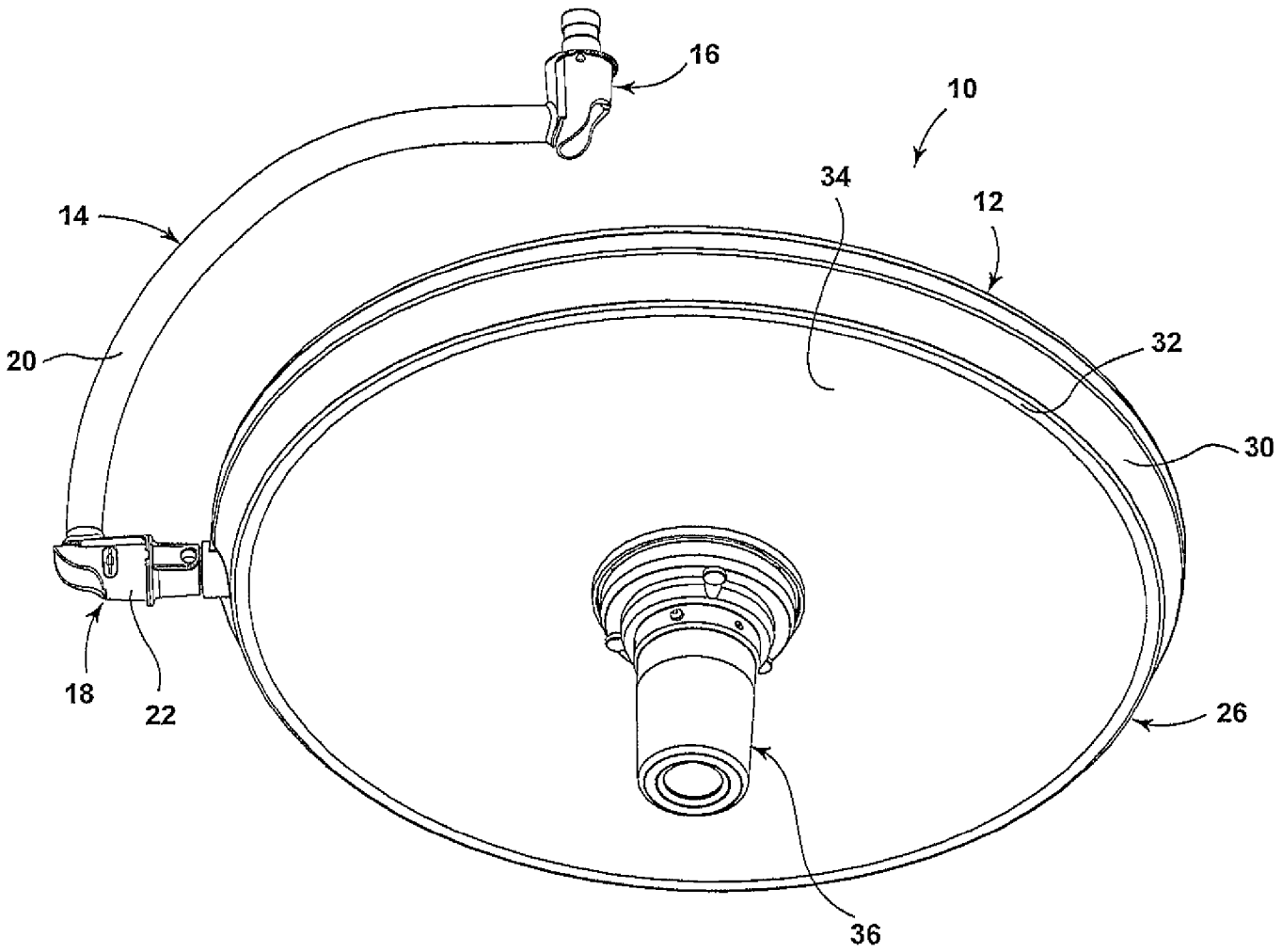
FIG. 1 illustrates a perspective view of a surgical light according to the invention.
Figure 4:
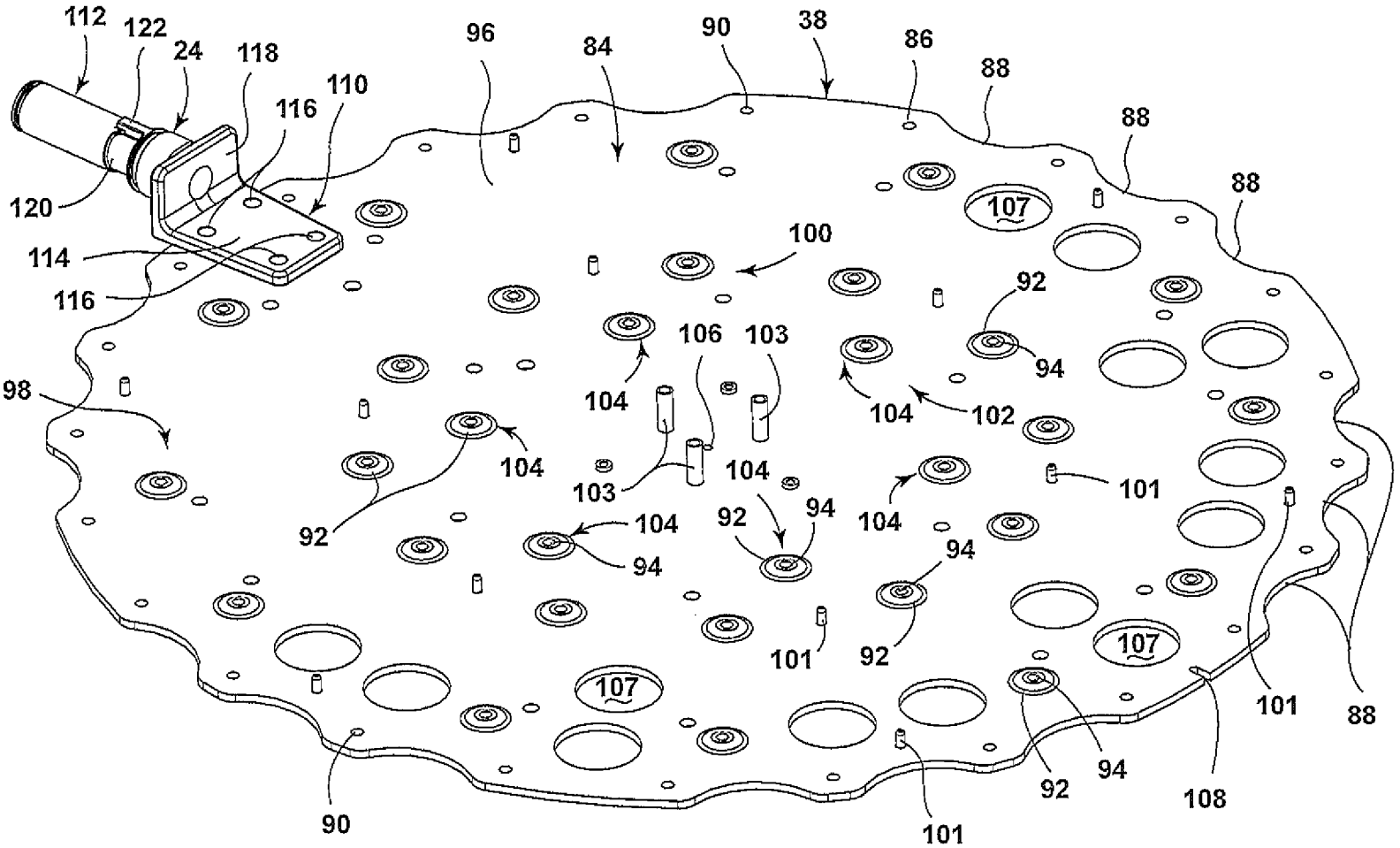
FIG. 4 is a top perspective view of a support plate and arm connection member of the light assembly of the surgical light according to the invention.

In the illustrated example, the arm 14 of the surgical light 10 allows light from the light assembly 12 to be pointed at a certain area within the operating room (with the suspension system allowing the light assembly 12 to be selectively positioned within the operating room). The arm 14 includes a first end connection member 16, a second end connection member 18 connected to the light assembly 12, and a curved link 20 extending between the first end connection member 16 and the second end connection member 18. The first end connection member 16 is configured to be connected to a structure of the operating room or a movable assembly as discussed above. The second end connection assembly 18 includes a receiver 22 for receiving an arm connection member 24 (see FIG. 4) for connecting the arm 14 to the light assembly 12. The arm connection member 24 is configured to rotate within the receiver 22 for allowing the light assembly 12 to rotate relative to the arm 14. While a specific arm 14 is illustrated in FIG. 1, any arm well known to those skilled in the art could be used to connect the light assembly 12 to the operating room structure or a movable assembly as discussed above (including one connected to multiple points on the side of the light assembly 12 and/or the rear surface thereof such that the arm connection member 24 is not needed and/or is replaced with another connection member). The illustrated arm 14 or any arm known to those skilled in the art allow for easy movement of the light assembly 12 into any position within the operating room and then maintaining the position of the light assembly 12 once released.

The illustrated light assembly 12 provides targeted increased light to a particular desired area of an operating room. The light assembly 12 includes a housing 26 having a rear cover 28, a rim 30, a bezel 32 and a circular face glass 34. The housing 26 has a handle assembly 36 for moving the housing 26. and light assembly 12 along with being capable of turning on, turning off, increasing and decreasing the intensity of the light emitted by the light assembly 12 as discussed in more detail below. The housing 26 encloses a support plate 38 and a plurality of lighting subassemblies 40 as discussed in more detail below.

Figure 3:
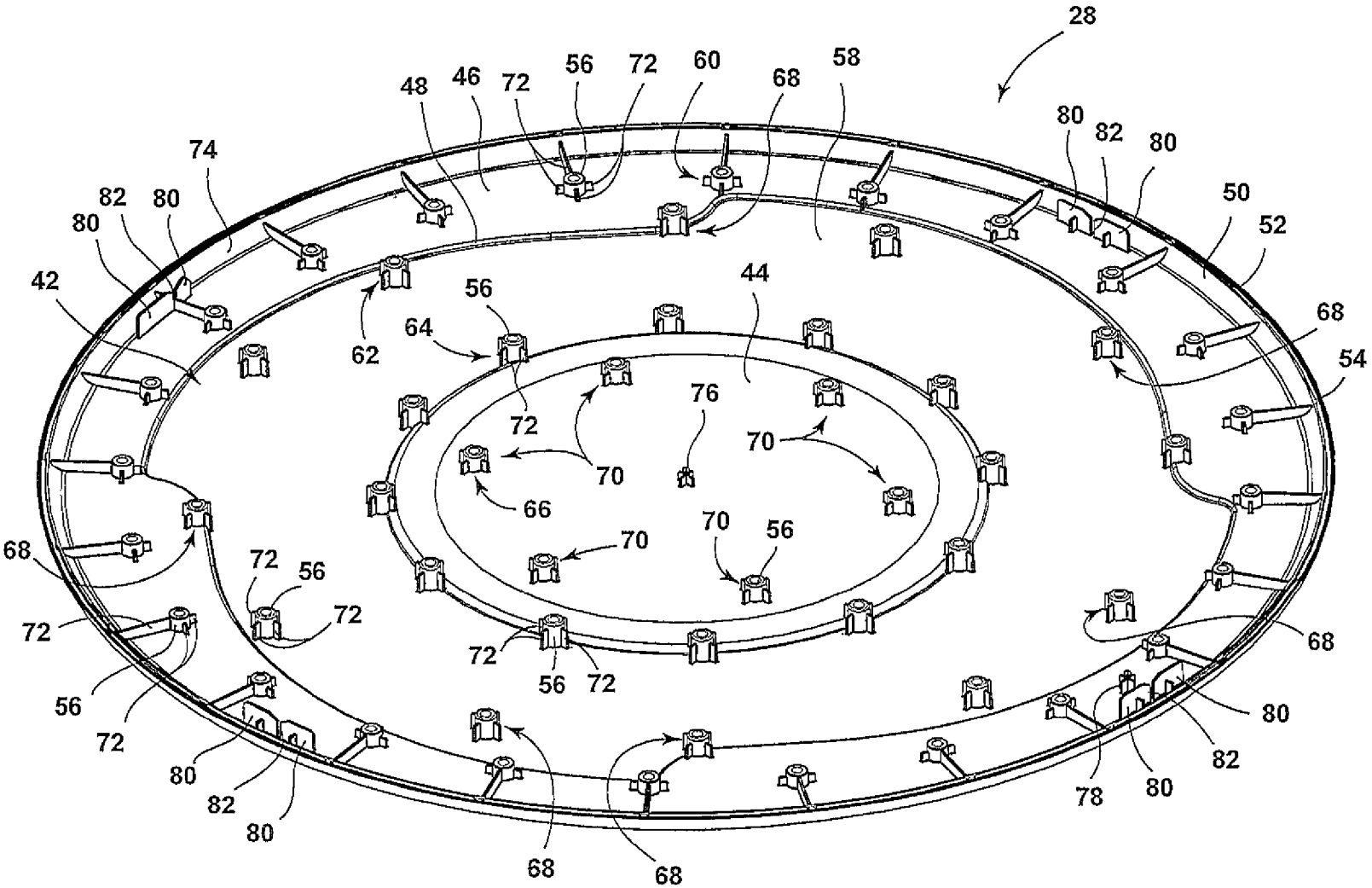
FIG. 3 is a top perspective view of a rear cover of a housing of a light assembly of the surgical light according to the invention.

In the illustrated example, the rear cover 28 (FIG. 3) of the housing 26 encloses a rear of the housing 26. The rear cover 28 includes a substantially circular stepped rear plate 42 having a circular raised center area 44 and a cosmetic stepped outer area 46. A cosmetic transition step 48 in the cosmetic stepped outer area 46 can form any configuration. It is also contemplated that the rear plate 42 could be substantially flat. A circular peripheral upwardly curved flange ring 50 extends upwards from an outside of the substantially circular stepped rear plate 42. An upwardly facing terminal edge 52 of the circular peripheral upwardly curved flange ring 50 includes a channel 54 therein for receiving the bezel 32.

In the illustrated embodiment, a plurality of inside threaded connection tubes 56 extend upwardly from an upper surface 58 of the substantially circular stepped rear plate 42. The plurality of inside threaded connection tubes 56 are arranged relative to one another so as to form an outer ring 60 of connection tubes 56, a first middle ring 62 of connection tubes 56, a second middle ring 64 of connection tubes 56 and an inner ring 66 of connection tubes 56. In the illustrated embodiment, the outer ring 60 includes twenty-four connection tubes 56 equally spaced from each other around the outer ring 60. The first middle ring 62 includes twelve connection tubes 56, with the connection tubes 56 of the first middle ring 62 having alternate short and long distances therebetween to form six pairs 68 of long distance connection tubes 56 of the first middle ring 62. The second middle ring 64 includes twelve connection tubes 56 being substantially equally spaced from each other around the second middle ring 64 adjacent the circular raised center area 44. The inner ring 66 includes six connection tubes 56 being substantially equally spaced from each other around the inner ring 66. One of the connection tubes 56 of the inner ring 66, two of the connection tubes 56 of the second middle ring 64 and one of the pairs 68 of the connection tubes 56 of the first middle ring 62 together substantially form a V-formation 70, with the connection tubes 56 of each V-formation 70 being used to connect one of the lighting subassemblies 40 to the rear cover 28 and the support plate 38. Each of the connection tubes 56 includes a plurality of struts 72 extending between an outer surface of the connection tubes 56 and either the upper surface 58 of the substantially circular stepped rear plate 42 or an inside concave surface 74 of the circular peripheral upwardly curved flange ring 50. While a particular number and location of connection tubes 56 are illustrated and described, it is contemplated that any number of connection tubes 56 in any location or formation could be used.

In the illustrated example, the rear cover 28 includes a center post 76 and an outer post 78 extending upwardly from the upper surface 58 of the substantially circular stepped rear plate 42 for aligning the support plate 38 thereon. Additionally, four pairs of alignment tabs 80 extend upwardly from the upper surface 58 of the substantially circular stepped rear plate 42 adjacent the outer periphery thereof, with the four pairs of alignment tabs 80 having a slot 82 therebetween for assisting in properly aligning the rim 30 on the rear cover 28. It is contemplated that the rear cover 28 could be made of a lightweight material (e.g., plastic) or any other suitable material.

In the illustrated example, the support plate 38 rests on the rear cover 28 and is captured between the rear cover 28 and the rim 30. The support plate 38 includes a substantially flat pane 84 having a generally circular outer edge 86 with six sets of a trio of inwardly-projecting recesses 88 therein, with each set of trio of recesses 88 being substantially equidistant from each other. An outer ring of fastener openings 90 extend through the flat pane 84 adjacent a periphery thereof, with the fastener openings 90 being configured to be aligned with the outer ring 60 of connection tubes 56 when the support plate 38 is positioned on the rear cover 28.

The illustrated support plate 38 includes a plurality of short screw bosses 92 having central holes 94 therein extending upwardly from a top surface 96 of the flat pane 84. The screw bosses 92 form an outer ring 98 aligned with the first middle ring 62 of connection tubes 56, a middle ring 100 aligned with the second middle ring 64 of connection tubes 56 and an inner ring 102 aligned with the inner ring 66 of connection tubes 56 when the support plate 38 is positioned on the rear cover 28. Two of the outer rings 98 of screw bosses 92, two of the middle rings 100 of screw bosses 92 and one of the inner rings 102 of screw bosses 92 form a V-formation 104 having the same arrangement as the V-formation 70 of the connection tubes 56 of the rear cover 28 such that each one of the screw bosses 92 rests on a top of each of the connection tubes 56 of the first middle ring 62, the second middle ring 64 and the inner middle ring 66 of connection tubes 56 when the support plate 38 is positioned on the rear cover 28. Each trio of recesses 88 in the outer edge 86 of the flat pane 84 are located within a pair of radial lines drawn from the center of the flat pane 84 and through the two screw bosses 92 of the outer ring 98 of screw bosses 92 of each one of the V-formation 104 of screw bosses 92. A pair of lighting assembly alignment posts 101 extend upwardly from the flat pane 84 within each V-formation 104 of screw bosses 92 for aligning the lighting subassemblies 40 on the support plate 38. Handle connection tubes 103 also extend upwardly from the flat pane 84 in a center area thereof, with the handle connection tubes 103 being configured to accept fasteners 290 (see FIGS. 11 and 12) therein for connecting the handle assembly 36 to the support plate 38. It is contemplated that the support plate 38 could be formed of a strong and rigid material (e.g., metal) or any material. It is further contemplated that the flat pane 84 could have weight reducing openings 107 therein for reducing the weight of the support plate 38.

In the illustrated example, the flat pane 84 includes a central hole 106 for accepting the center post 76 of the rear cover 28 and an outer slot 108 extending inwardly therefrom the outer edge 86 of the flat pane 84 for accepting the outer post 78 of the rear cover 28 when the support plate 38 is positioned on the rear cover 28. The engagement of the central hole 106 with the center post 76 and the outer slot 108 with the outer post 78 allows for the support plate 38 to be properly aligned within the rear cover 28. An outer portion of the flat pane 84 opposite the outer slot 108 includes four holes therein for connecting the arm connection member 24 to the support plate 38.

The illustrated arm connection member 24 is connected to the support plate 38 and allows the light assembly 12 to rotate relative to the arm 14. The arm connection member 24 includes an L-shaped connector 110 and a connection tube 112. The L-shaped connector 110 includes a bottom portion 114 having four fastener openings 116 therein for accepting fasteners (not shown) therethrough and into the four holes in the outer portion of the flat pane 84 opposite the outer slot 108 to connect the arm connection member 24 to the support plate 38. The L-shaped connector 110 also includes an upwardly extending portion 118 extending upwardly substantially perpendicularly to the bottom portion 114 of the L-shaped connector 110. The connection tube 112 extends outwardly from an outer surface of the upwardly extending portion 118 of the L-shaped connector 110. The connection tube 112 is configured to be inserted into the receiver 22 of the second end connection member 18 of the arm 14. The connection tube 112 includes a circumferential slot 120 for maintaining the connection tube 112 within the receiver 22 and an axial flange 122 on an outer surface thereof to limit rotation of the light assembly 12 relative to the arm 14. While a particular arm connection member 24 is shown, the housing 26 can be connected to the arm 14 in any manner.

Figure 5:
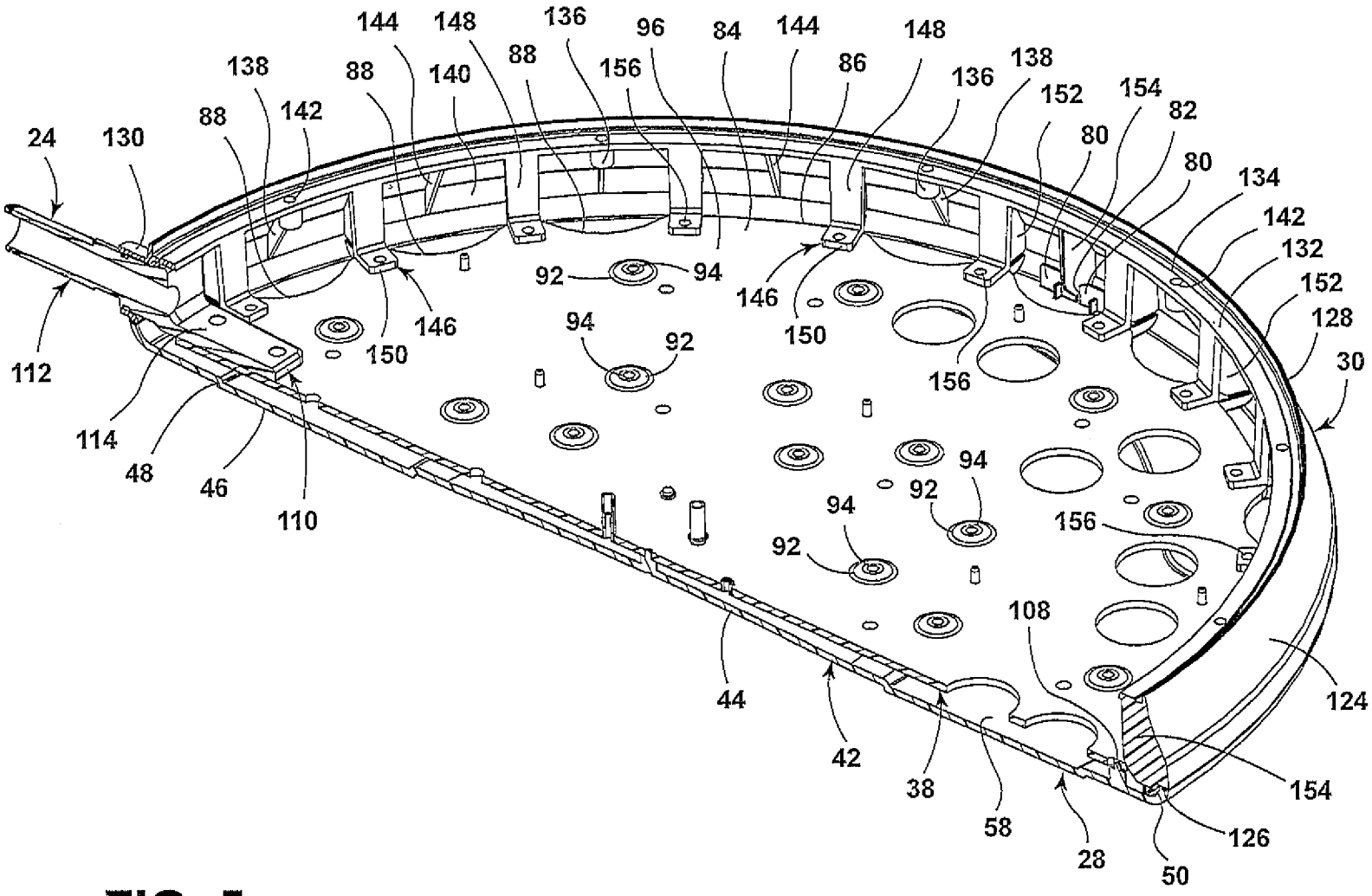
FIG. 5 is a top perspective and partial cross-sectional view of the support plate, arm connection member and rim of the light assembly of the surgical light according to the invention.

In the illustrated example, the rim 30 is positioned on the top surface 96 of the flat pane 84 of the support plate 38. The rim 30 includes an outer ring wall 124 having a bottom edge 126 covering the edge 52 of the curved flange ring 50 of the rear cover 28. The outer ring wall 124 can slope inwardly toward a center of the light assembly 12 in a direction from the bottom edge 126 towards a top edge 128 of the outer ring wall 124. As illustrated in FIG. 5, the outer ring wall 124 includes a tube accepting opening 130 having the connection tube 112 of the arm connection member 24 extending therethrough. A top cantilever ring 132 extends inwardly from the outer ring wall 124 a short distance from the top edge 128 thereof. A channel 134 is located in the outer periphery of the top cantilever ring 132 at the intersection of the top cantilever ring 132 and the outer ring wall 124, with the channel 134 accepting a portion of the bezel 32 therein. A plurality of equidistant bezel connection tubes 136 extend downwardly from a bottom surface of the top cantilever ring 132, with each bezel connection tube 136 having a strut 138 extending between the bezel connection tube 136 and the inner surface 140 of the outer ring wall 124. A fastener opening 142 extends though the top cantilever ring 132 and into each bezel connection tube 136. An auxiliary strut 144 extends between a bottom surface of the top cantilever ring 132 and the inner surface 140 of the outer ring wall 124 between each bezel connection tube 136 for support.

The illustrated rim 30 includes a plurality of L-shaped connection legs 146 resting on the top surface 96 of the flat pane 84 of the support plate 38. The L-shaped connection legs 146 each include a vertical portion 148 extending downwardly from an inner periphery of the top cantilever ring 132 and a substantially inwardly extending horizontal portion 150. A brace 152 extends between an outer surface of the vertical portion 148 of the L-shaped connection legs 146 and the inner surface 140 of the outer ring wall 124 for providing support for each L-shaped connection leg 146. The rim 30 further includes four radially extending alignment plates 154 extending inwardly from the inner surface 140 of the outer ring wall 124.

Figure 2:
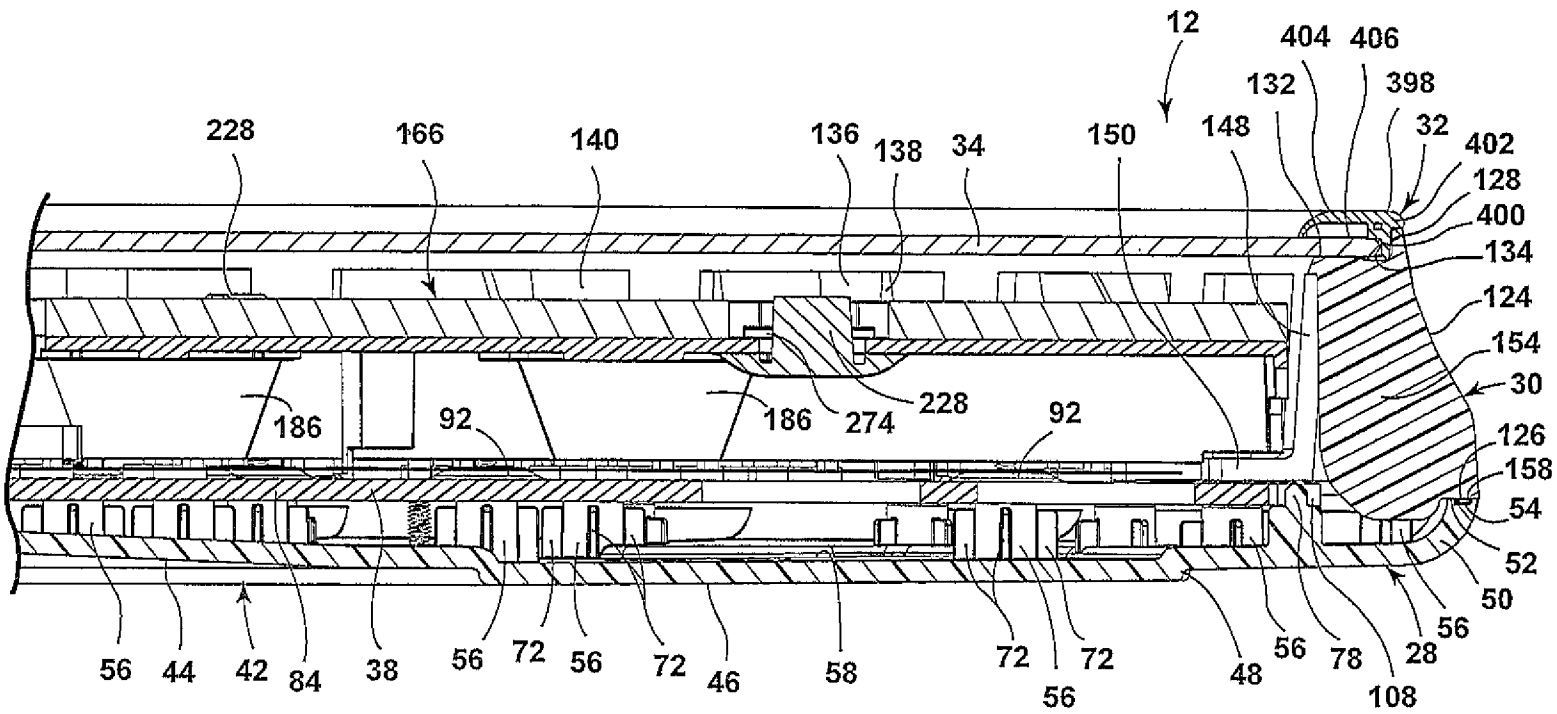
FIG. 2 is a partial cross-sectional view of the surgical light of FIG. 1 according to the invention.

In the illustrated example, the support plate 38 is captured between the rim 30 and the rear cover 28 (see FIGS. 2 and 5). To assemble the housing 26, the support plate 38 is positioned on the rear cover 28. In order to properly position the support plate 38 on the rear cover 26, the outer post 78 of the rear cover 28 is inserted into the central hole 106 in the flat pane 84 of the support plate 38 and the outer post 78 is positioned within the outer slot 108 in the flat pane 84 of the support plate 38. When the support plate 38 is properly positioned on the rear cover 28, the outer ring 60 of connection tubes 56 of the rear cover 26 will be aligned with the outer ring of fastener openings 90 in the flat pane 84 of the support plate 38. Furthermore, all of the screw bosses 92 of each V-formation 104 of the support plate 38 will be located over the connection tubes 56 of each V-formation 70 of the rear cover 28.

The illustrated rim 30 is then positioned over the support plate 38 to continue to assemble the housing 26. It is contemplated that the arm connection member 24 could be connected to the support plate 38 and then extended through the tube accepting opening 130 of the rim 30 before the rim 30 and the support plate 38 are positioned on the rear cover 28 or that the arm connection member 24 could be extended through the tube accepting opening 130 of the rim 30 after the support plate 38 and the rim 30 are positioned on the rear cover 28 (and then connected to the support plate 38). In order to properly position the rim 30 relative to the support plate 38 and the rear cover 28, the alignment plates 154 are inserted into the slots 82 between the alignment tabs 80 in the rear cover 28. It is contemplated that the slots 82 could be equidistant from each other such that the rim 30, the arm connection member 24 and the support plate 38 could be at any of a limited number of positions (e.g., 4) on the rear cover 28 or that the slots 82 could be at various distances from each other such that the rim 30, the arm connection member 24 and the support plate 38 can only have one position on the rear cover 28. It is contemplated that the rim 30 could be made of any material (e.g., plastic or metal).

In the illustrated example, once the rim 30 and the support plate 38 are positioned on the rear cover 28, openings 156 in the horizontal portions 150 of the L-shaped connection legs 146 of the rim 30 will be aligned with the outer ring 60 of connection tubes 56 of the rear cover 28, which are aligned with the outer ring of fastener openings 90 in the flat pane 84 of the support plate 38. Fasteners (not shown) can then be inserted into the openings 156 in the horizontal portions 150 of the L-shaped connection legs 146 of the rim 30, the outer ring of fastener openings 90 in the flat pane 84 of the support plate 38 and the outer ring 60 of connection tubes 56 of the rear cover 28 to fixedly connect the rim 30, the support plate 38 and the rear cover 28 together. As illustrated in FIG. 2, an o-ring seal 158 can be placed in the channel 54 in the upwardly facing terminal edge 52 of the curved flange ring 50 of the rear cover 28, thereby providing a seal between the rear cover 28 and the rim 30 between the upwardly facing terminal edge 52 of the curved flange ring 50 of the rear cover 28 and the bottom edge 126 of the cuter ring wall 124 of the rim 30. Once the lighting subassemblies 40 are inserted into the housing 26, the bezel 32 and the face glass 34, along with the handle assembly 36, can be connected to the rest of the housing 26.

Figure 6:
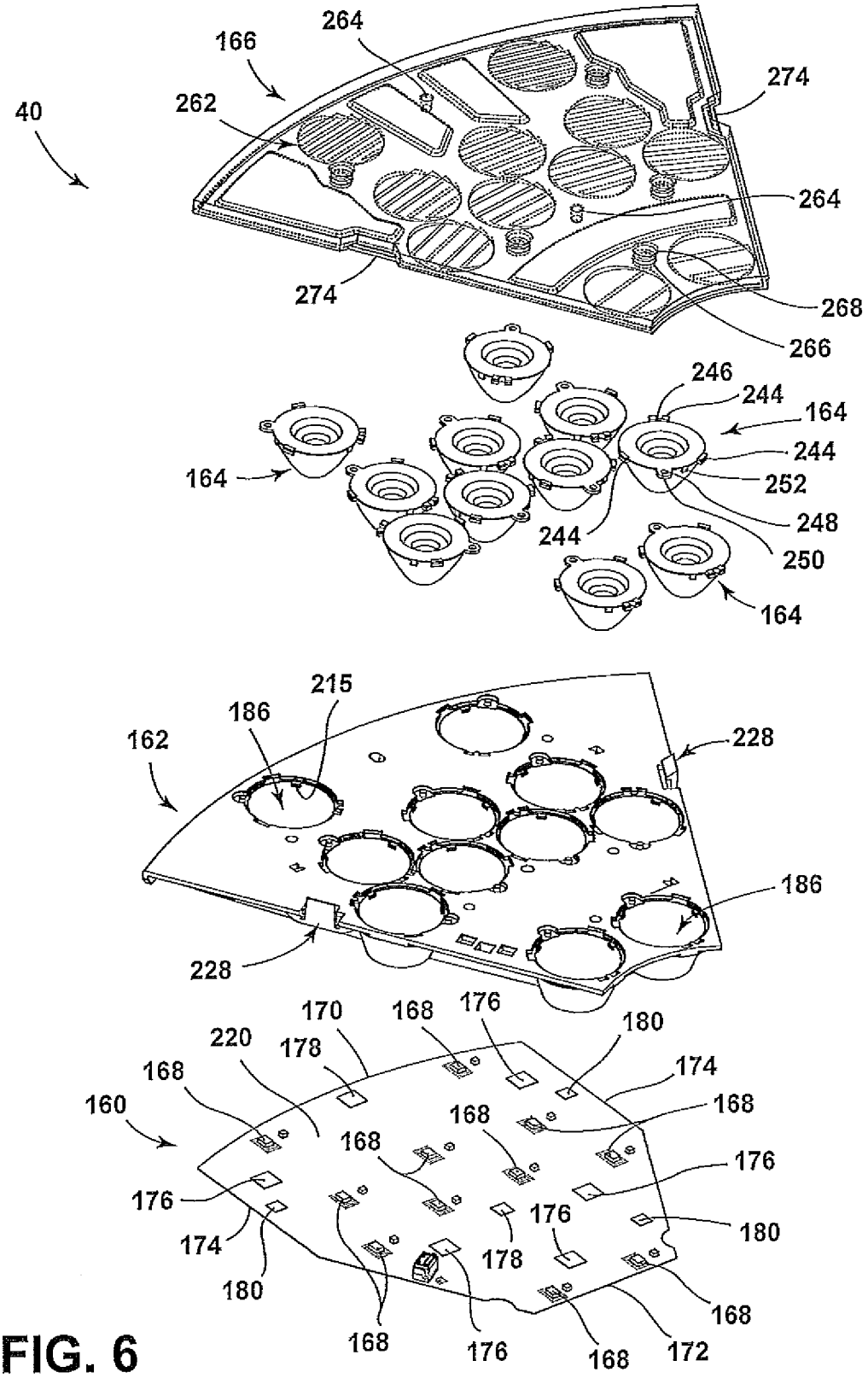
FIG. 6 is an exploded perspective view of a lighting subassembly of the light assembly of the surgical light according to the invention.

The illustrated lighting subassemblies 40 (FIG. 6) provide the light for the surgical light 10. Each lighting subassembly 40 includes a printed circuit board (PCB) 160, a first optic holder 162, a plurality of first optic elements 164 and a second optic element 166. In the illustrated example, the surgical light 10 includes six lighting subassemblies 40 within the housing 26, with each of the lighting subassemblies 40 being located over one of the V-formations 104 of the support plate 38 aligned with one of the V-formations 70 of the rear cover 28 and providing approximately 60° of a ring. However, it is contemplated that any number of lighting subassemblies 40 could be located within the housing 26 (including only one lighting subassembly 40). In the illustrated example, the lighting subassemblies 40 each provide approximately the same amount of light.

In the illustrated example, each PCB 160 includes a plurality of light emitting diodes (LEDs) 168 thereon for emitting light. Each PCB 160 has an outer arcuate edge 170, a substantially straight inner edge 172 and a pair of bent side edges 174. The outer arcuate edges 170 of the PCBs 160 when positioned on the support plate 38 extend for about 60° of a circle as described above. The LEDs 168 are located in rows located at four radial distances from a center of the light assembly 12 when the lighting subassemblies 40 are positioned within the housing 26. An innermost row of LEDs 168 includes two LEDs 168 located adjacent the inner edge 172 of the PCB 160. A first middle row of LEDs 168 includes four LEDs 168 located approximately 40% of the way between the inner edge 172 and the outer arcuate edge 170 of the PCB 160. A second middle row of LEDs 168 includes three LEDs 168 located approximately 60% of the way between the inner edge 172 and the outer arcuate edge 170 of the PCB 160. An outer row of LEDs 168 includes two LEDs 168 located adjacent the outer arcuate edge 170 of the PCB 160. While a particular positioning of the LEDs 168 is illustrated, it is contemplated that the LEDs 168 could include any number of LEDs 168 in any location on the PCB 160 and that each PCB 160 could have a different number of LEDs 168 and/or LEDs 168 in different locations. However, it is preferred that all of the elements of each of the lighting subassemblies 40 have the same configuration. As is well known to those skilled in the art, and as used herein, the term LED comprises a diode having integrated optical components encapsulating the diode. The LEDs 168 can emit a cone of light. For example, the LEDs 168 can emit a cone of light having a cross-section covering an angle of approximately 120° (i.e., a 60° half angle) or approximately 80° (i.e., a 40° half angle) or any other angle typically emitted form an LED.

Each illustrated PCB 160 includes a plurality of fastener holes 176 that are aligned with the screw bosses 92 of one of the V-formations 104 when the PCB 160 is positioned on the support plate 38. Each PCB 160 also includes a plurality of alignment openings 178 configured to accept the alignment posts 101 of the support plate 38 when the PCB 160 is positioned on the support plate 38. The alignment openings 178 include two alignment openings 178 radially aligned along a center of the PCB 160. The PCB 160 also includes three hook holes 180 configured to receive hooks 182 of the first optic holder 162 therein for assisting in connecting the first optic holder 162 to the PCB 160. The hook holes 180 are located along each bent side edge 174 of the PCB 160 and adjacent an intersection of the inner edge 172 and one of the bent side edges 174 and assist in connecting the first optic holder 162 to the PCB 160.

Figure 7:
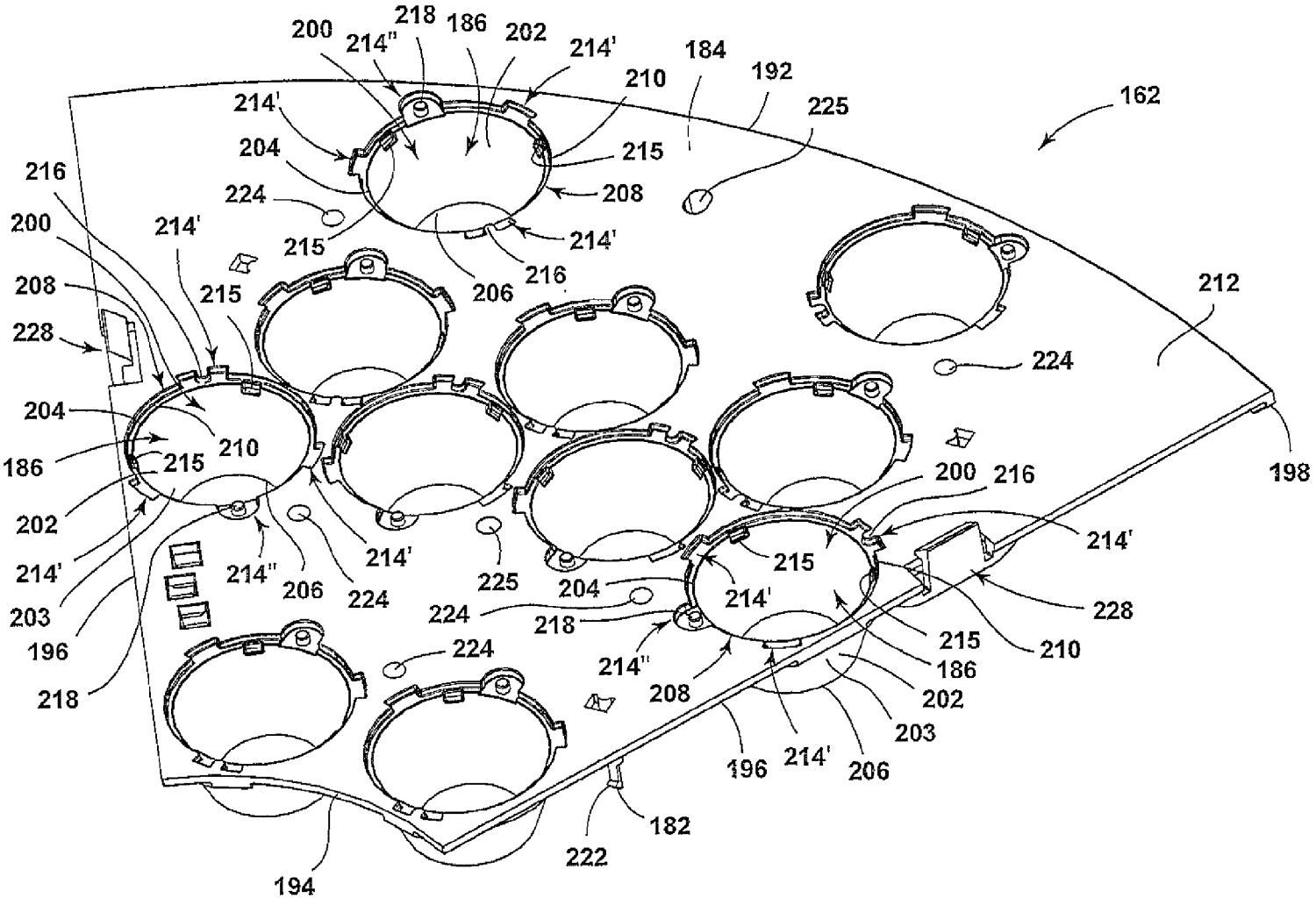
FIG. 7 is a top perspective view of a first optic holder of the lighting subassembly of the light assembly of the surgical light according to the invention.

In the illustrated example, the first optic holder 162 (FIGS. 6-8) is connected to the PCB 160 and houses the first optic elements 164 therein. The first optic holder 162 includes a top plate 184 having first optic holding sleeves 186, fastener tubes 188, and a holder buttressing system 190. The hooks 182 depend downwardly from the top plate 184. The top plate 184 includes an outer arcuate edge 192, an inner arcuate edge 194 and a pair of side edges 196. An outer lip 198 extends downwardly from the outer arcuate edge 192 to provide rigidity for the top plate 184.

The illustrated first optic holding sleeves 186 extend downwardly from the top plate 184, with the top plate 184 having openings 200 above the first optic holding sleeves 186. The first optic holding sleeves 186 include a substantially conical tube 202 having a wall 203 with a bowl-shaped curvature cross-section, a large diameter upper end 204 and a small diameter lower end 206. The top plate 184 includes a recess 208 surrounding each first optic holding sleeve 186 forming a step 210 between the large diameter upper end 204 of the conical tube 202 and a top surface 212 of the top plate 184. The step 210 includes a plurality of alignment bays for assisting in properly aligning one of the first optic elements 164 in each of the first optic holding sleeves 186. The alignment bays include three wedge-shaped bays 214', with one of the wedge-shaped bays 214' having a tab 216 extending into a center thereof from the top surface 212 of the top plate 184. The alignment bays also include one arcuate bay 214" having a middle post 218 extending upwardly from the step 210 in a middle of the arcuate bay 214". The alignment bays further include a plurality of short niches 215 formed into the step 210 between the step 210 and the wall 203 of the substantially conical tube 202. It is contemplated that some of the alignment bays could be used solely as points for attachment (e.g., untrasonic) or could be used for both alignment and attachment.

In the illustrated example, the first optic holder 162 is positioned over the PCB 160 such that each LED 168 is centered along an axis of one of the conical tubes 202 of the first optic holding sleeves 186 and in the center of the small diameter lower end 206 of the conical tube 202. However, the LEDs 168 could be located anywhere under the first optic holding sleeves 186 as long as the first optic elements 164 direct the light from the LEDs 168 in the desired direction into the second optic element 166. In the illustrated embodiment, the first optic elements 164 redirect the light from the LEDs 168 into a direction substantially perpendicular to a top surface 220 of the PCB 160 and the top surface 212 of the top plate 184.

The illustrated first optic holder 162 is connected to the PCB 160 using fasteners (not shown) and the hooks 182. The first optic holder 162 includes the three hooks 182 extending downwardly from the top plate 184. During assembly of the lighting subassemblies 40, the hooks 182 of the first optic holder 162 are aligned with the three hook holes 180 in the PCB 160. The first optic holder 162 is lowered onto the PCB 160 until the small diameter lower ends 206 of the conical tubes 202 of the first optic holding sleeves 186 abut or are located adjacent to the top surface 220 of the PCB 160. When lowered, the hooks 182 will extend through the hook holes 180 in the PCB 160 and a lip 222 at the bottom end of the hooks 182 will snap into place under a bottom surface of the PCB 160.

Figure 8:
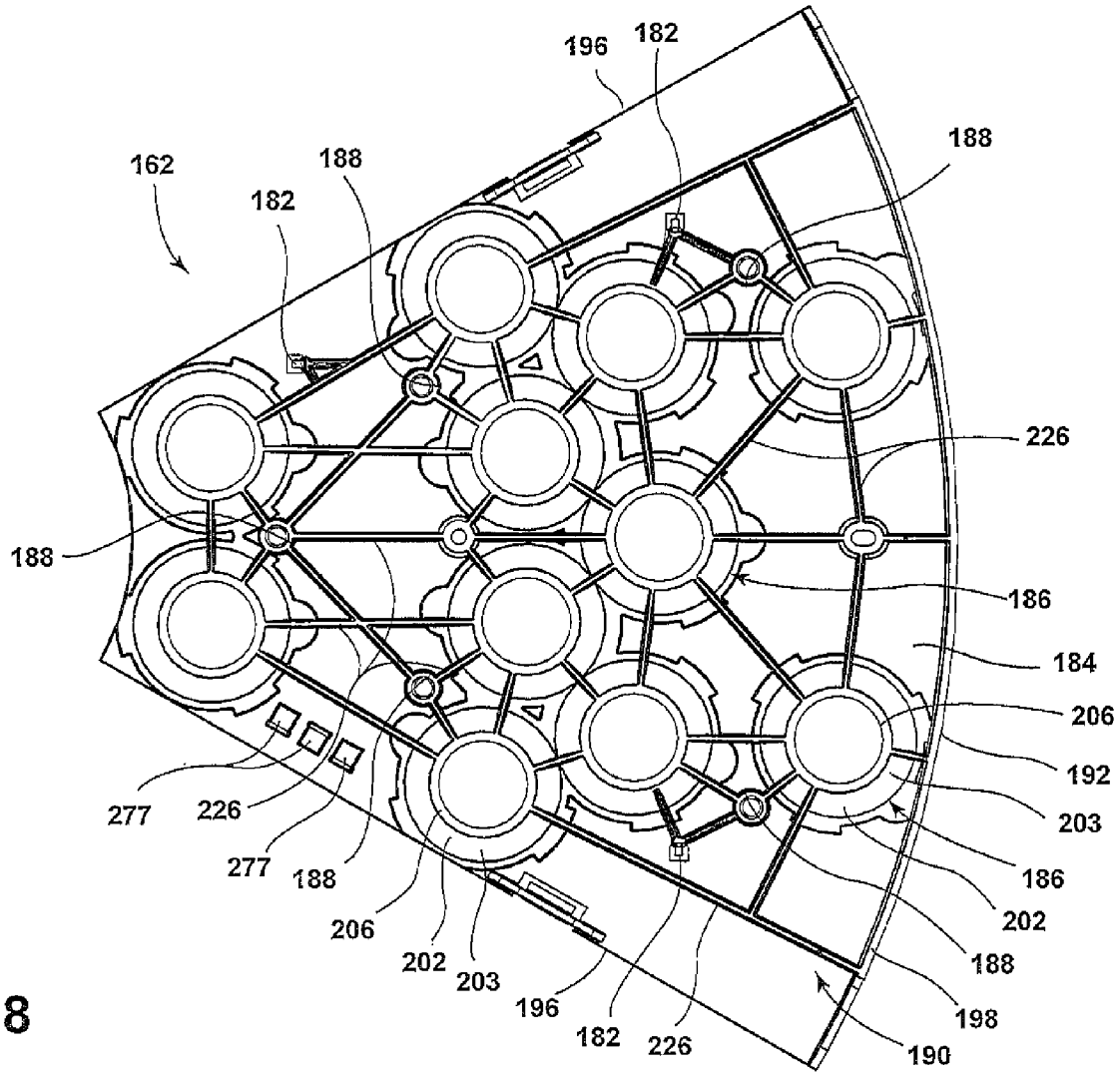
FIG. 8 is a bottom view of the first optic holder of the lighting subassembly of the light assembly of the surgical light according to the invention.

In the illustrated example, when the first optic holder 162 is connected to the PCB 160 using the hooks 182, the fastener tubes 188 will be aligned with the fastener holes 176 in the PCB 160. The fastener tubes 188 depend downwardly from the top plate 184, with holes 224 being located within the top plate 184 over every fastener tube 188. As illustrated in FIG. 8, the holder buttressing system 190 includes buttresses 226 extending between the fastener tubes 188, the first optic holding sleeves 186, the hooks 182 and the outer lip 198. The holder buttressing system 190 provides rigidity and support for the first optic holder 162. The first optic holder 162 also includes a pair of upstanding catches 228 extending upward from the side edges 196 of the top plate 184 of the first optic holder 162, with the catches 228 being configured to snap over sides of the second optic element 166 when the second optic element 166 is positioned onto the first optic holder 162. It is contemplated that the first optic holder 162 could be made from any suitable material (e.g., injection molded plastic).

Figure 9:
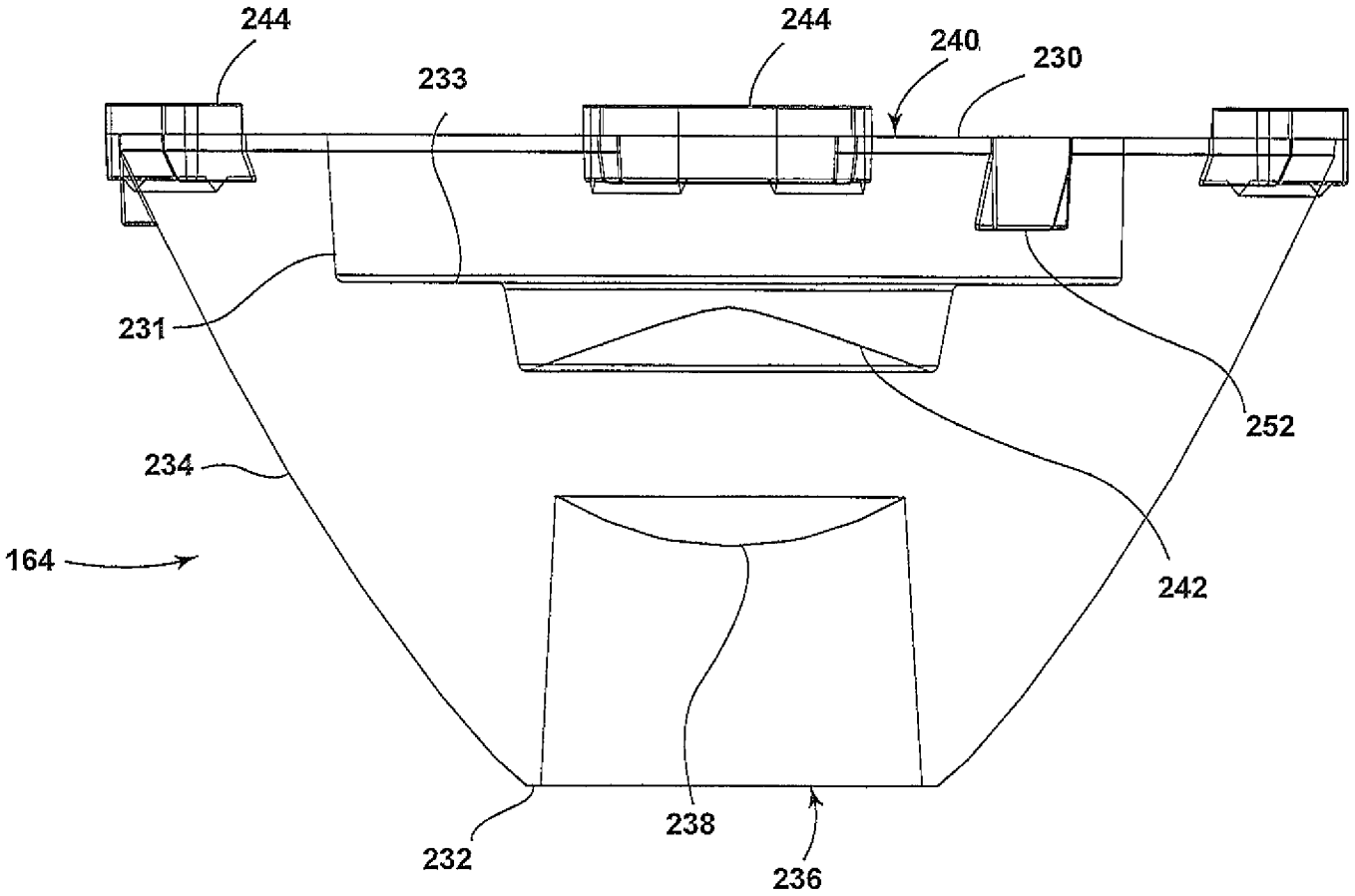
FIG. 9 is a side view of a first optic element of the lighting subassembly of the light assembly of the surgical light according to the invention.

The illustrated first optic elements 164 (FIG. 9) are configured to redirect the light from the LEDs 168 to the second optic element 166. Each first optic element 164 is bowl-shaped and includes a large top surface 230, a small bottom surface 232 spaced downwardly therefrom and a curved side surface 234 extending between the large top surface 230 and the small bottom surface 232. In the illustrated embodiment, the curved side surface 234 has an increasing slope in a direction from a bottom to a top thereof. The small bottom surface 232 has a bottom centrally located decreasing diameter frusto-conical recess 236 therein, with the bottom centrally located frusto-conical recess 236 ending in a bottom convex end surface 238. Likewise, the large top surface 230 has a large cylindrical counter-bore 231 and a top centrally located decreasing diameter frusto-conical recess 240 extending from a bottom surface 233 of the large cylindrical counter-bore 231, with the top centrally located frusto-conical recess 240 ending in a top convex end surface 242. A central axis of the bottom centrally located decreasing diameter frusto-conical recess 236, the bottom convex end surface 238, the top centrally located decreasing diameter frusto-conical recess 240 and the top convex end surface 242 can be colinear. In the illustrated embodiment, each first optic element 164 is centrally located over the LED 168 and is configured to redirect all light from the LED 168. In the illustrated embodiment, each first optic element 164 collimates the light emitted from the LED 168 to reduce the angle of spread of the cone of light (with the angle of spread being the angle between lines of the cone on a plane passing through the axis of the cone). For example, the first optic element 164 can reduce the angle of the cone of light emitted from the LED 168 from 120° (half angle of 60°) such that the cone of light exiting the first optic element has an angle of spread of 40° (half angle of 20°), 16° (half angle of 8°), or 4° (half angle of 2°). Other angles of spread exiting the first optic element 164 are contemplated. For an angle of spread of the cone of light being about 4° (half angle of 2°) or less, such an angle of spread of the cone of light is considered to be substantially perpendicular to the top surface 220 of the PCB 160. The design, shape and material of the first optic elements 164 to direct light in the desired direction is well known to those skilled in the art. It is contemplated that the first optic elements 164 could be total internal reflection elements.

In the illustrated example, each first optic element 164 includes a plurality of alignment projections (see FIG. 6) extending outwardly from the curved side surface 234 adjacent the large top surface 230 for properly aligning the first optic elements 164 within the first optic holder 162. The alignment projections include a plurality of wedge shaped projections 244, with one of the wedge projections 244 having an end indentation 246. The alignment projections also include an arcuate projection 248 having a central opening 250 therein. The alignment projections further include a plurality of short tabs 252 that have a greater height relative to the other alignment projections. It is contemplated that some of the alignment bays and alignment projections could be used solely as points for attachment (e.g., untrasonic) or could be used for both alignment and attachment.

When the illustrated first optic elements 164 are positioned within the first optic holding sleeves 186 of the first optic holder 162, the alignment projections will rest within the alignment bays of the first optic holding sleeves 186. Specifically, the wedge shaped projections 244 will nestle within the three wedge-shaped bays 214', with the end indentation 246 of one of the wedge shaped projections 244 receiving the tab 216. Furthermore, the arcuate projection 248 will rest within the arcuate bay 214", with the middle post 218 of the arcuate bay 214" extending into the central opening 250 of the arcuate projection 248. Moreover, the short tabs 252 will be received within the short niches 215. While a particular number and shape of alignment tabs and alignment bays have been illustrated and described, it is contemplated that any number of alignment tabs and alignment bays having any geometry could be used (including only one alignment tab and alignment bay). Furthermore, as outlined above, some of the alignment bays and tabs could be used solely for attachment or for both alignment and attachment.

Figure 10:
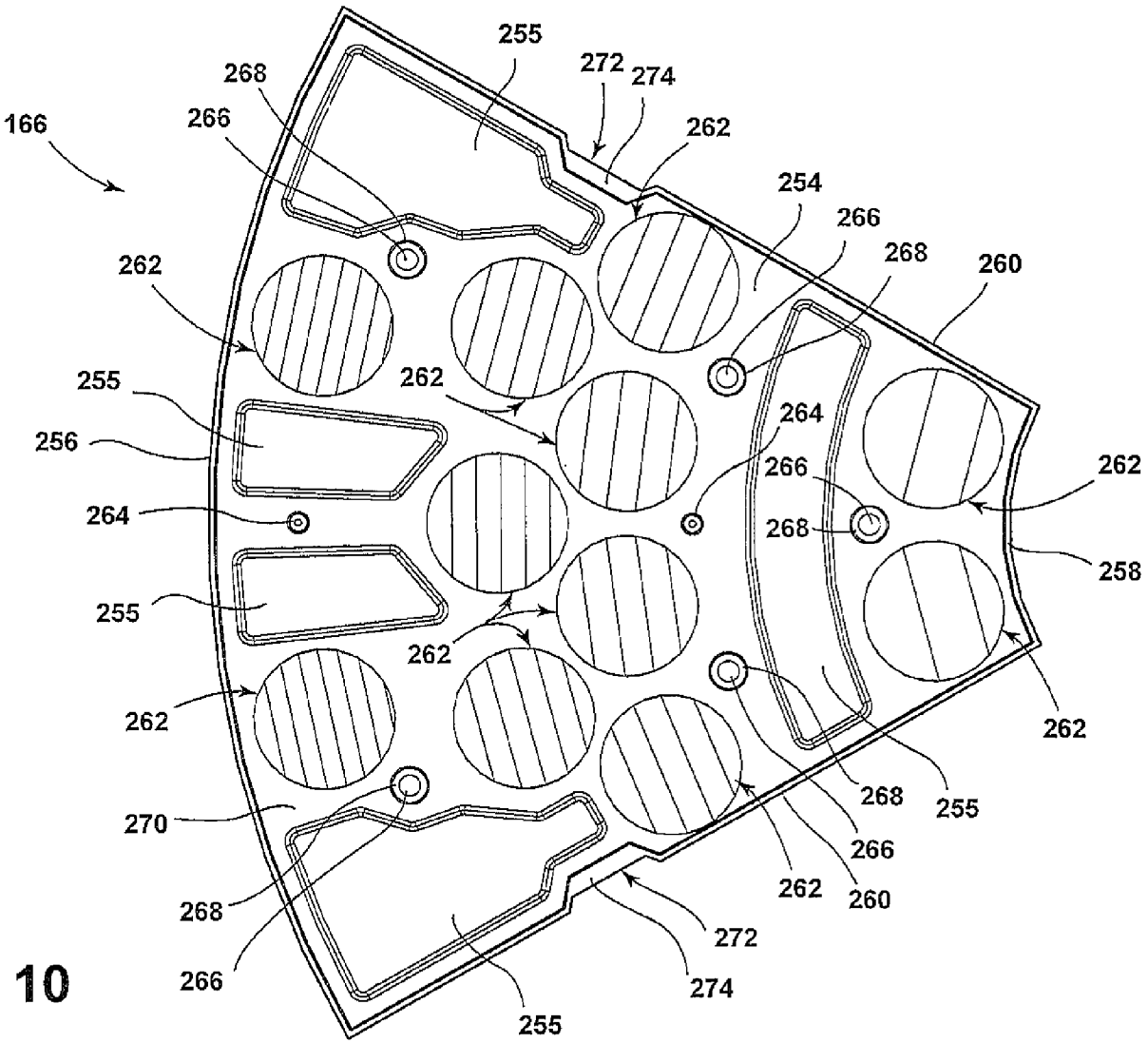
FIG. 10 is a top view of a second optic element of the lighting subassembly of the light assembly of the surgical light according to the invention.

In the illustrated example, the second optic element 166 (FIG. 10) redirects the light from the first optic elements 164 to a desired location. The second optic element 166 includes a substantially transparent plate 254 having a periphery substantially identical to a periphery of the top plate 184 of the first optic holder 162. The substantially transparent plate 254 has an arcuate outer edge 256, an arcuate inner edge 258 and a pair of angled side edges 260. A plurality of circular lens areas 262 are formed in the plate 254, with the circular lens areas 262 each forming a faceted Fresnel lens (or other light directing lens) and positioned over the LEDs 168 and the first optic elements 164 as described in more detail below. The plate 254 can include a plurality of thinner areas 255 to reduce the weight of the second optic element 166. It is contemplated that the plate 254 could have more or less thinner areas 255 than those illustrated in FIG. 10. The plate 254 can include lens areas 262 being the only transparent or translucent portion of the plate 254, with the rest of the plate 254 and second optic element 166 being translucent and/or opaque. It is contemplated that the second optic element 166 could be non-uniform (e.g., a structure which hold or mounts the lenses instead of an integral structure having lens areas), could be made of any material or materials (e.g., plastic or plastic and metal) and that the lens areas 242 could have a shape other than circular.

The illustrated second optic element 166 includes features for connecting the second optic element 166 to the first optic holder 162 and the PCB 160. The second optic element 166 includes a pair of radially aligned downwardly depending posts 264 configured to be inserted into openings 225 in the top plate 184 of the first optic holder 162 when the second optic element 166 is placed on the top surface 212 of the top plate 184 of the first optic holder 162 to properly align the first optic holder 162 with the second optic element 166. The second optic element 166 includes a plurality of screw openings 266 configured to be aligned with the holes 224 over the fastener tubes 188 of the first optic holder 162. Screw head recesses 268 are formed in a top surface 270 of the plate 254 and surround the screw openings 266 in the plate 254. The second optic element 166 also includes a pair of inwardly-projecting side recesses 272 formed in the side edges 260 of the plate 254 which open outwardly therefrom, with thin flanges 274 extending over and across the side recesses 272.

In the illustrated example, the lighting subassemblies 40 are assembled by placing the first optic elements 164 into their proper positions within the first optic holding sleeves 186 in the first optic holder 162 (and can be fixed into position (e.g., by ultrasonic welding)). The second optic element 166 is then snap fit over the first optic holder 162 by snapping the catches 228 over the flanges 274 extending across the side recesses 272 in the side edges 260 of the plate 254 of the second optic element 166 along with inserting the pair of radially aligned downwardly depending posts 264 into the openings 225 in the top plate 184 of the first optic holder 162. Moreover, the hooks 182 of the first optic holder 162 are inserted into the hook holes 180 in the PCB 160. It is contemplated that the PCB 160, the first optic holder 162 and the second optic element 166 could be connected to one another in other manners (e.g., via fasteners in other locations). It is contemplated that the first optic holder 162 could include a plurality of openings 277 for routing of cables connected to the PCB 160 (see FIG. 8).

Once the illustrated lighting subassemblies 40 are assembled, the lighting subassemblies 40 are then positioned within the housing 26. In order to properly position the lighting subassemblies 40 within the housing 26, the pair of lighting assembly alignment posts 101 extending upwardly from the flat pane 84 of the support plate 38 are inserted into the alignment openings 178 in the PCB 160. Fasteners (not shown) can then be inserted through the lighting subassemblies 40 and into the support plate 38 to securely connect the lighting subassemblies 40 to the housing 26. The fasteners are inserted through the plurality of screw openings 266 in the plate 254 of the second optic element 166, with heads of the fasteners being received within the screw head recesses 268 in the top surface 270 of the plate 254. The fasteners also extend through the holes 224 in the top plate 184 of the first optic holder 162, through the fastener tubes 188 of the first optic holder 162, through the fastener holes 176 in the PCB 160 and into the central holes 94 of the screw bosses 92 of the support plate 38. The central holes 94 of the screw bosses 92 of the support plate 38 can be threaded to receive the fasteners or can include a nut or similar device thereunder for holding the fasteners in position, with the nut or similar device locking into position under the screw bosses 92.

All of the illustrated lighting subassemblies 40 positioned within the housing 26 substantially form a ring, with the handle assembly 36 located in a center of the ring adjacent the inner edges 172 of the PCBs 160, the inner arcuate edges 194 of the top plates 184 of the first optic holders 162 and the inner arcuate edges 258 of the plate 254 of the second optic element 166. The handle assembly 36 includes a lower stationary portion 276 and an upper rotatable portion 278. The lower stationary portion 276 receives a center opening (not shown) in the face glass 34 of the light assembly 12. The upper rotatable portion 278 is configured to rotate relative to the lower stationary portion 276 to increase or decrease the intensity of the light emitted by the LEDs 168, turn the LEDs 168 on and turn the LEDs 168 off. It is contemplated that a control system (not shown) for the surgical light 10 can be located under the handle assembly 36).

In the illustrated example, the lower stationary portion 276 of the handle assembly 36 is connected to the support plate 38. The lower stationary portion 276 of the handle assembly 36 includes a base disc 280 having a central opening 282 and an outer L-shaped ring flange 284 extending downwardly from the outer edge of the base disc 280. Three connection tubes 288 extend downwardly from the base disc 280, with fasteners 290 extending through the connection tubes 288 and into the handle connection tubes 103 extending upwardly from a central portion of the pane 84 of the support plate 38 to rigidly connect the lower stationary portion 276 of the handle assembly 36 to the support plate 38. The base disc 280 includes an enlarged ring 286 surrounding the central opening 282.

Figure 12:
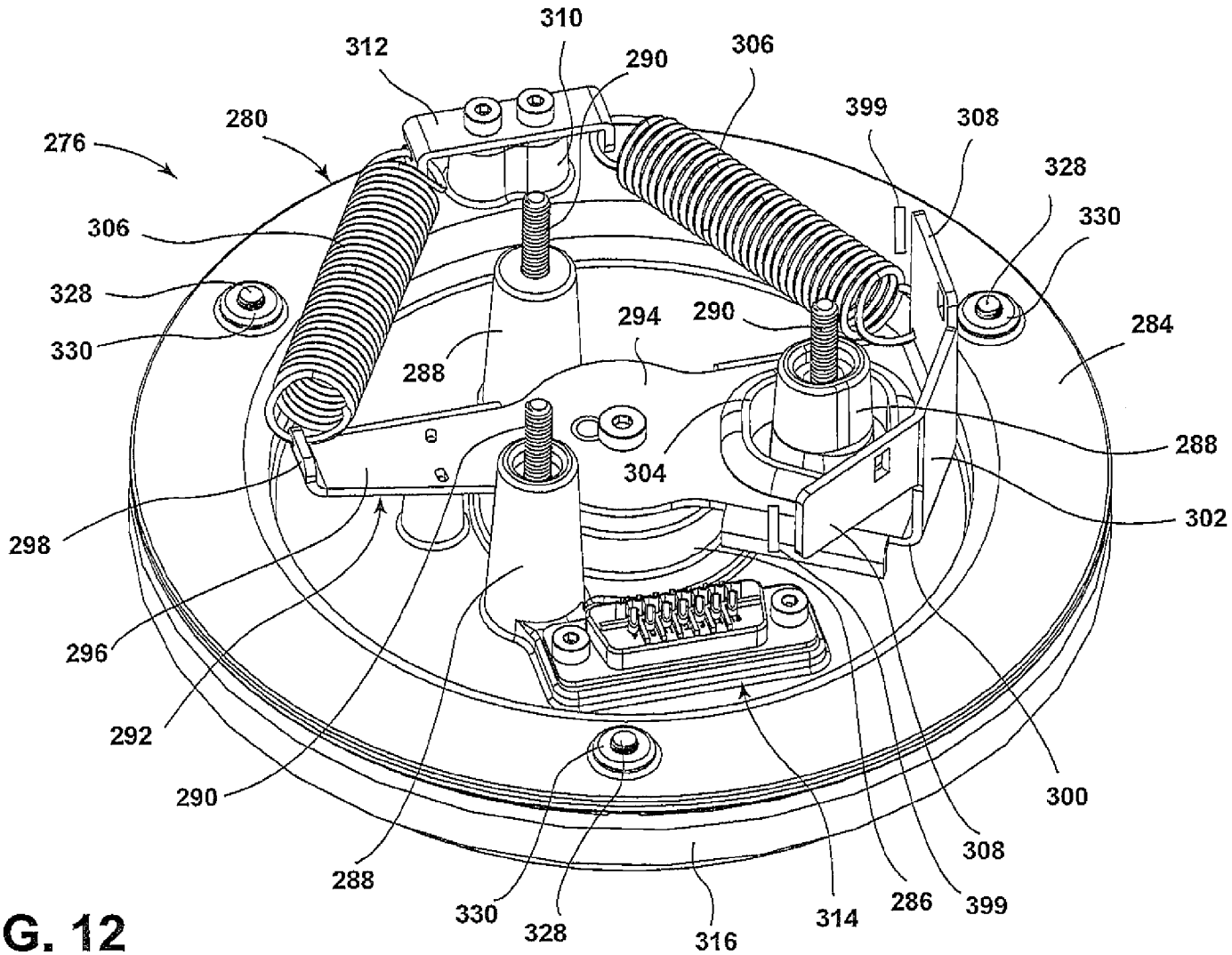
FIG. 12 is a bottom perspective view of a lower stationary portion of the handle assembly of the surgical light according to the invention.

The illustrated lower stationary portion 276 of the handle assembly 36 includes a switch plate 292 abutting against a bottom surface of the enlarged ring 286 of the base disc 280. The switch plate 292 rotates with the upper rotatable portion 278 of the handle assembly 36 to alter the lighting of the LEDs 168. The switch plate 292 includes a central hub 294 having a center hole 297, with the central hub 294 rotating about a center of the central opening 282 of the base disc 280. The switch plate 292 also includes a first arm 296 extending radially from the central hub 294 and having an upstanding biasing arm 298. A second arm 300 extends radially from the central hub 294 and has an upstanding biasing and actuation finger 302. In the illustrated embodiment, the second arm 300 includes an aperture 304 in a center thereof allowing one of the connection tubes 288 to extend therethrough and to limit rotational movement of the switch plate 292 as opposite sides of the aperture 304 abut against the connection tube 288 located within the aperture 304. Springs 306 are connected to both the first arm 296 and the second arm 300 to maintain the switch plate 292 in a selected position because the springs 306 will act against each other. The switch plate 292 includes a pair of oppositely extending abutment tabs 308 configured to abut against switches (shown schematically at 399) to increase or decrease the intensity of the light emitted by the LEDs 168, turn the LEDs 168 on and turn the LEDs 168 off. Use of such switches are well known to those skilled in the art. It is contemplated that another portion of the switch plate 292 could activate the switches in order to alter the intensity of the LEDs 168. As illustrated in FIG. 12, the base disc 208 includes a spring support block 310 extending downwardly therefrom, with the spring support block 310 having a U-shaped spring holder 312 connected thereto and holding ends of the springs 306 that are opposite to the first arm 296 and the second arm 300. The base disc 280 can also include a first communication connector 314 extending therethrough for communicating information from the upper rotatable portion 278 of the handle assembly 36 to the remainder of the light assembly 12 and through the arm 14 if desired.

Figure 11:
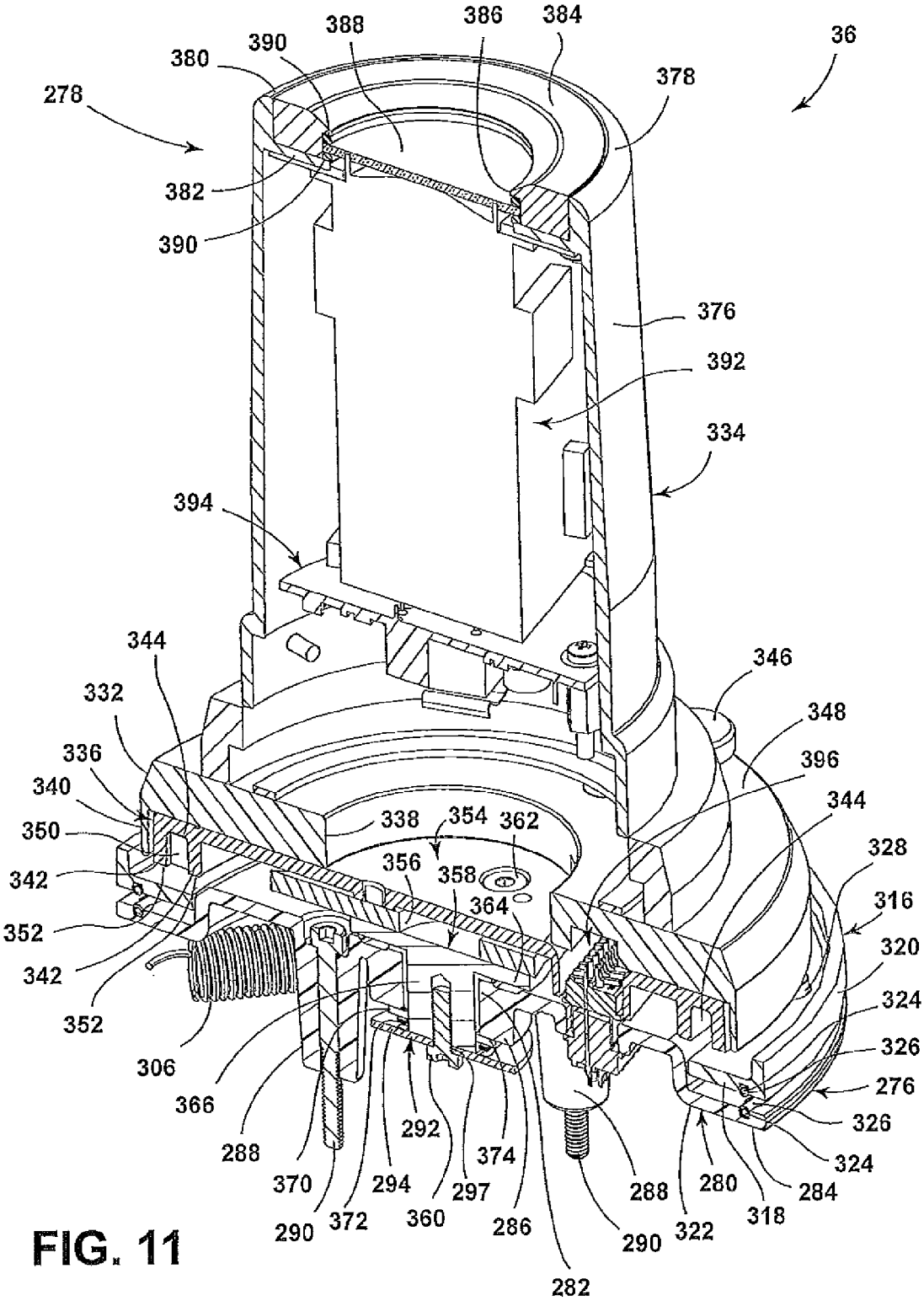
FIG. 11 is a perspective and partial cross-sectional view of a handle assembly of the surgical light according to the invention.

In the illustrated example, the lower stationary portion 276 of the handle assembly 36 also includes an L-shaped cover 316, with an inner periphery of the circular face glass 34 being trapped between the L-shaped cover 316 and the outer L-shaped ring flange 284 of the lower stationary portion 276. The L-shaped cover 316 includes a bottom portion 318 and an upstanding outer portion 320. The circular face glass 34 has a central circular opening and the inner periphery of the face glass 34 is trapped between the bottom portion 318 of the L-shaped cover 316 and a bottom leg 322 of the outer L-shaped ring flange 284 of the lower stationary portion 276. The bottom portion 318 of the L-shaped cover 316 and the bottom leg 322 of the outer L-shaped ring flange 284 can each include a channel 324 having an o-ring seal 326 therein for sealing the interior of the light assembly 12 from contamination. As illustrated in FIGS. 11 and 12, fasteners 328 extend through the bottom leg 322 of the outer L-shaped ring flange 284, through holes in the face glass 34 adjacent the central circular opening thereof, and through the bottom portion 318 of the L-shaped cover 316 to maintain the face glass 34 in a selected rotational position, with nuts 330 holding the fasteners 328 in position, thereby securing the bottom portion 318 of the L-shaped cover 316 to the bottom leg 322 of the outer L-shaped ring flange 284 and securely capturing the face glass 34. An outer periphery of the face glass 34 is captured between the rim 30 and the bezel 32 as described in more detail below.

The illustrated upper rotatable portion 278 of the handle assembly 36 is able to rotate relative to the lower stationary portion 276 to control the LEDs 168. The upper rotatable portion 278 includes a substantially circular base pedestal 332 centrally positioned over the lower stationary portion 276, a stepped cylinder 334 and a disc seal 336. The substantially circular base pedestal 332 includes a central opening 338 and a downwardly depending outer ring 340. The disc seal 336 is located in an area under the substantially circular base pedestal 332 and inside of the downwardly depending outer ring 340. The disc seal 336 includes a pair of downwardly depending ring flanges 342 defining a receiving area 344. A plurality of fasteners 346 extend through a top outer surface 348 of the substantially circular base pedestal 332 and into one or more receiving blocks 350 located within the receiving area 344 of the disc seal 336 to fixedly connect the disc seal 336 to the base pedestal 332. Lower edges 352 of the ring flanges 342 of the disc seal 336 engage the lower stationary portion 276 of the handle assembly 36 to provide a seal therebetween as the upper rotatable portion 278 is rotated.

In the illustrated example, the upper rotatable portion 278 of the handle assembly 36 is connected to the switch plate 292 of the lower stationary portion 276 to rotate the switch plate 292 by a connection assembly 354. The connection assembly 354 includes an upper washer 356 connected to the disc seal 336, a T-shaped connector 358 connected to the upper washer 356 and a fastener 360. The upper washer 356 is located under a central portion of the disc seal 336 and is fixed thereto by a fastener 362. The T-shaped connector 358 includes a top plate 364 connected to the upper washer 356 and the disc seal 336 by the fastener 362. The top plate 364 rides on a top of the base disc 280 of the lower stationary portion 276 around the central opening 282, with a cylinder 366 of the T-shaped connector 358 extending through the central opening 282 in the base disc 280. The fastener 360 extends through the center hole 297 of the central hub 294 of the switch plate 292 and is inserted into the cylinder 366 of the T-shaped connector 358, thereby fixedly connecting the switch plate 292 to the upper rotatable portion 278 of the handle assembly 36. As illustrated in FIG. 11, a lower washer 370 and a slide ring 372 can be located between a bottom surface 374 of the enlarged ring 286 surrounding the central opening 282 of the base disc 280 to allow for the switch plate 292 to easily rotate relative to the base disc 280 of the lower stationary portion 276. It is contemplated that the upper rotatable portion 278 and the lower stationary portion 276 could be connected in other manners.

The illustrated upper rotatable portion 278 of the handle assembly 36 also includes the stepped cylinder 334 connected to a top of the substantially circular base pedestal 332, with the stepped cylinder 334 providing a grip surface 376 for moving the light assembly 12 and for rotating the upper rotatable portion 278. The stepped cylinder 334 has an upper end 378 having an opening 380 therein. A ring ledge 382 is located within the stepped cylinder 334 adjacent the upper end 378. A ring seal 384 is located within the opening 380 and on the ring ledge 382. The ring seal 384 has an inner flange 386 and a transparent lens 388 is located between two o-rings 390 sandwiched between the ring ledge 382 adjacent an inner periphery thereof and under the inner flange 386. A fastener (not shown) can extend through the ring ledge 382 and into the ring seal 384 to secure the ring seal 384 and the transparent lens 388 to the rest of the stepped cylinder 334. In the illustrated example, a camera 392 is fixed in location within the stepped cylinder 334 and under the transparent lens 388. The camera 392 has a control plate 394 adjacent thereto, with the control plate 394 controlling the camera 392 and sending images captured by the camera 392 through a second communication connecter 396 in the disc seal 336 which communicates with the first communication connector 314 in the lower stationary portion 276 of the handle assembly 36 via a spring connector (not shown) or other methods known to those skilled in the art. Images captured by the camera 392 can be sent to monitors through communication cable lines extending through the arm 12 or wirelessly in a manner known to those skilled in the art.

In the illustrated example, rotation of the upper rotatable portion 278 of the handle assembly 36 relative to the lower stationary portion 276 increases or decreases the intensity of the light emitted by the LEDs 168, turns the LEDs 168 on and turns the LEDs 168 off. First, rotating the upper rotatable portion 278 of the handle assembly 36 in a first direction can turn the LEDs 168 on at a first intensity by having one of the pair of oppositely extending abutment tabs 308 (or similar element) of the switch plate 292 abut against a first switch 399. After releasing the upper rotatable portion 278 of the handle assembly 36, the upper rotatable portion 278 will return to an initial position under bias of the springs 306 of the handle assembly 36. The upper rotatable portion 278 of the handle assembly 36 can then be rotated again in the first direction a plurality of times, with each rotation increasing the intensity of the LEDs 168. The upper rotatable portion 278 of the handle assembly 36 can be rotated in a second direction opposite to the first direction to decrease the intensity of the LEDs 168, with each successive rotation decreasing the intensity of the LEDs 168 until the LEDs 168 are at their lowest intensity. It is contemplated that the LEDs 168 could be turned off by turning the upper rotatable portion 278 of the handle assembly 36 in the second direction and holding the upper rotatable portion 278 of the handle assembly 36 in a furthest rotational position for a set period of time. While a particular handle assembly 36 is shown, it is contemplated that other handle assemblies could be used. Furthermore, while a particular manner of increasing and decreasing the intensity of the light emitted by the LEDs 168, turning the LEDs 168 on and turning the LEDs 168 off, it is contemplated that other methods of controlling the LEDs 168 and intensity thereof could be used (including having a control located on the handle assembly 36, on the housing 26, on a wall or other structure of the operating room or by using a remote control).

The illustrated face glass 34 along with the handle assembly 36 can be inserted into the housing 26, with an outer periphery of the face glass 34 being captured between the rim 30 and the bezel 32. The bezel 32 (FIG. 2) includes a base ring 398 having an inner slot 400 for receiving an outer periphery of the face glass 34. The bezel 32 also has an outer flange 402 and an inwardly extending flap 404. As illustrated in FIG. 2, the base ring 398 rests on the channel 134 in the top cantilever ring 132 of the rim 30, with the outer periphery of the face glass 34 inside of the bezel 32 resting on the top cantilever ring 132 radially inside of the channel 134. Furthermore, the outer flange 402 rests on the top edge 128 of the outer ring wall 124 of the rim 30. The inwardly extending flap 404 covers an upper surface 406 of the outer periphery of the face glass 34. Fasteners (not shown) can be positioned under the inwardly extending flap 404, through holes (not shown) in the outer periphery of the face glass 34 and into the fastener openings 142 and the bezel connection tubes 136 to securely connect the bezel 32 to the rest of the housing 26. It is contemplated that the rim 30 could be made of any suitable material (e.g., metal, plastic or elastomer).

In use, the light assembly 12 can be moved to a desired position and the LEDs 168 can be turned on and off using the handle assembly 36 as described above. When the LEDs 168 are turned on, the LEDs 168 emit light. It is contemplated that the LEDs 168 can emit a cone of light having a cross-section covering an angle of approximately 120°. The light emitted from the LEDs 168 is received within the first optic elements 164, which reflect and redirect the light towards the second optic element 166. In the illustrated embodiment, substantially all of the light leaving the first optic elements 164 travel in a parallel direction substantially perpendicular to the top surface 220 of the PCB 160 and the top surface 212 of the top plate 184 of the second optic element 166. The circular lens areas 262 formed in the plate 254 of the second optic element 166 will then redirect or focus the light coming from the light assembly 12 at a distance (e.g., 1 meter) from the light assembly 12. The light can also be directed to overlap at the area to maximize shadow resolution. The circular lens areas 262 can be used to redirect an already focused beam. For the handle assembly 36 illustrated herein, it is contemplated that the upper rotatable portion 278 may not be able to rotate when the upper rotatable portion 278 has the camera 392 therein as the control plate 394 controlling the camera 392 and the second communication connecter 396 may be solidly connected together along with a receiver for the control plate 394 on the support plate 38. If the upper rotatable portion 278 is not able to rotate, the LEDs 168 can be controlled to turn on and off using another control (e.g., control placed elsewhere on the light assembly, by remote control or by a wall control functionally connected to the light assembly 12).

The reference numeral 12*a* (FIG. 13) generally designates second embodiment of the light assembly of the present invention. Since light assembly 12*a* is similar to the previously described light assembly 12, similar parts appearing in FIGS. 1-12 and FIG. 13, respectively, are represented by the same, corresponding reference number, except for the suffix "a" in the numerals of the latter. The light assembly 12*a* is identical to the previous light assembly 12, except that the PCB 160*a* includes copper plates 500 on the top surface 220*a* of a core material of the PCB 160*a* and a bottom surface 510 of a core material of the PCB 160*a* (such that the copper plates 500 are part of the PCB 160*a*), a thermal pad 502 located between the PCB 160*a* and the support plate 38*a*, and a plurality of vias 504 (e.g., of copper) extending between the copper plates 500 and contacting the thermal pad 502 for transferring heat from the LEDs 168*a* to the copper plate 500 on the top surface 220*a* of the PCB 160*a*, along the vias 504, to the copper plate 500 on the bottom surface 510 of the PCB 160*a*, to the thermal pad 502 and then to the support plate 38*a*, which acts as a heat sink. The copper plates 500, the vias 504, the thermal pad 502 and the support plate 38*a* are used to dissipate heat from the LEDs 168*a*. Accordingly, use of the vias 504 allow heat at a top of the light assembly near the LEDs to move away from the top of the light assembly (e.g., the area of the light assembly closest to a surgeon and a patient in an operating room) to a rear of the light assembly ((e.g., away from the area of the light assembly closest to a surgeon and a patient in an operating room). It is contemplated that any heat of the first optical elements can contact the PCB 160*a* such that any heat from the first optical elements can also be transferred to the heat sink through the copper plates 500, the vias 504 and the thermal pad 502. It is also contemplated that the plates 500 could be another heat conducting material and that the vias could comprise any heat conducting material extending through holes in the core material of the PCB 160*a*. The screw bosses are embossed to not only control the position of the PCB 160*a* to the support plate 38*a* as discussed above, but also controls compression of the thermal pad 502 and, consequently, the force on the PCB 160*a*. It is contemplated that the support plate 38*a* could also be painted to improve emissivity of the support plate 38*a* to improve heat dissipation.

Figure 14:
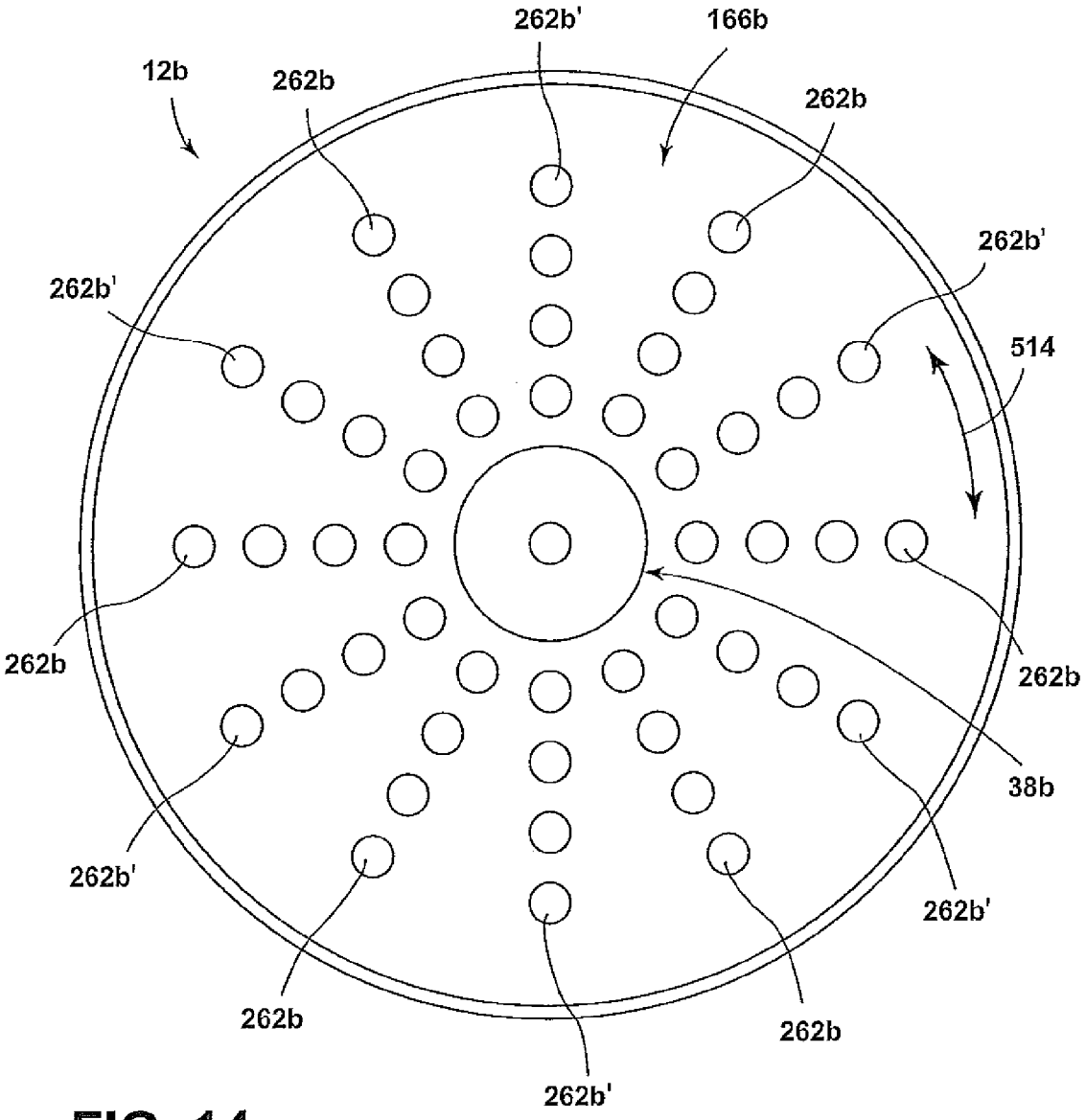
FIG. 14 is a top view of a third embodiment of the light assembly according to the invention.

The reference numeral 12*b* (FIG. 14) generally designates a third embodiment of the light assembly of the present invention. Since light assembly 12*b* is similar to the previously described light assembly 12, similar parts appearing in FIGS. 1-12 and FIG. 14, respectively, are represented by the same, corresponding reference number, except for the suffix "b" in the numerals of the latter. In the third embodiment of the light assembly 12*b*, the LED and first optic elements are radially aligned in six rows. The second optic element 166*b* is generally disc-shaped and has an opening in the center for mounting of the handle assembly 36*b*. The second optic element 166*b* includes a first set of six rows of lens areas 262*b* for redirecting the light from the first optic elements into a first direction and/or focusing the light at a first distance from the second optic element 166*b*. The handle assembly 36*b* is configured to rotate in order to move the second optic element 166*b* in a rotary direction along line 514. As the second optic element 166*b* is rotated, the first set of six rows of lens areas 262*b* will be moved out from in front of the first optic elements and a second set of six rows of lens areas 262*b*' will be positioned in front of the first optic elements in order to redirect the light from the first optic elements into a second direction and/or focusing the light at a second distance from the second optic element 166*b*.

It is contemplated that the illustrated light assembly 12*b* could have LEDs, first optic elements and lens areas 262*b* of the second optic element 166*b* in any configuration with any number of LEDs, first optic elements and first set of lens areas 262*b*, with the second set of lens areas 262*b*' being equal in number to the first set of lens areas 262*b*. It is contemplated that the change from first set of lens areas 262*b* to the second set of lens areas 262*b*' could be gradual to allow for gradual adjustment of the direction of the light or focus point of the light. It is also contemplated that the handle assembly 36*b* could be used only to rotate the second optic element 166*b*, with controls for the LEDs being elsewhere (e.g., on the housing or elsewhere in an operating room). Furthermore, it is contemplated that the second optic element 166*b* could be rotated using a slider (or other mechanical member) or could be controlled electronically instead of using the handle assembly 36*b*, with the handle assembly 36*b* being any of the handle assemblies described herein.

Figure 15:
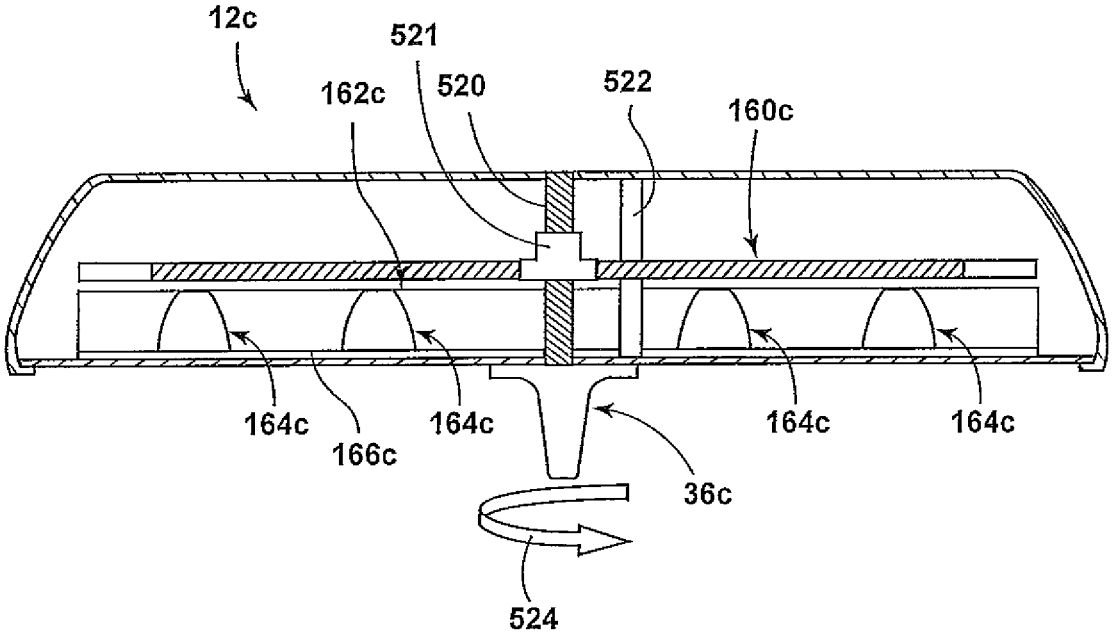
FIG. 15 is a partial schematic cross-sectional view of a fourth embodiment of the light assembly according to the invention.
Figure 16:
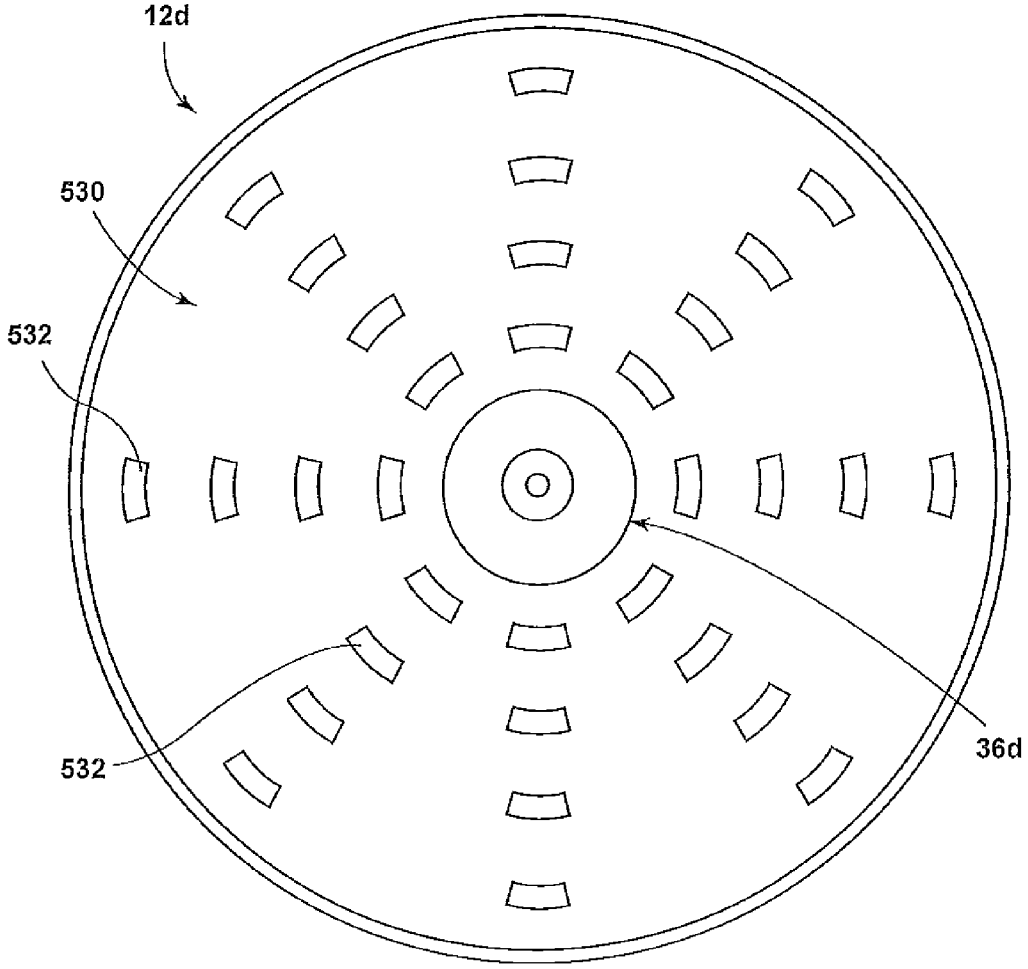
FIG. 16 is a top view of a fifth embodiment of the light assembly according to the invention.
Figure 17:
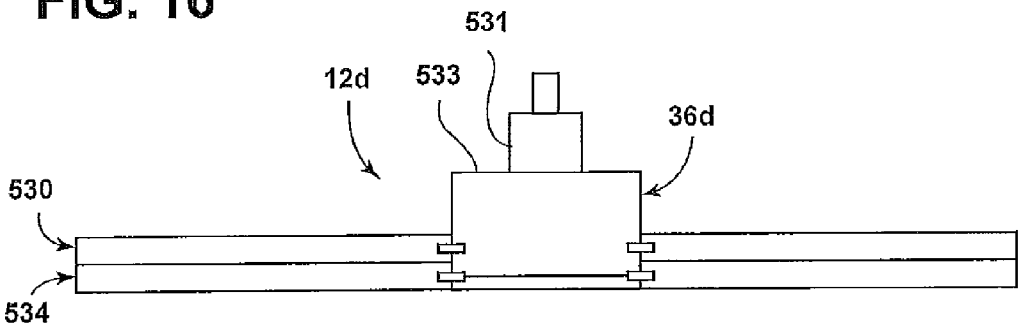
FIG. 17 is a partial schematic cross-sectional view of the fifth embodiment of the light assembly according to the invention.

The reference numeral 12*c* (FIG. 15) generally designates a fourth embodiment of the light assembly of the present invention. Since light assembly 12*c* is similar to the previously described light assembly 12, similar parts appearing in FIGS. 1-12 and FIG. 15, respectively, are represented by the same, corresponding reference number, except for the suffix "c" in the numerals of the latter. In the fourth embodiment of the light assembly 12*c*, the handle 36*c* is employed to move the PCB(s) 160*c* relative to the first optic holder 162*c*, the first optic element 164*c* and the second optic element 166*c* to adjust a direction and/or a focus distance of the light emitted from the second optic element 166*c*. In the illustrated example, the PCB(s) 160*c* are moved relative to the first optic holder 162*c*, the first optic element 164*c* and the second optic element 166*c* by rotating the handle assembly 36*c* along line 524. Rotation of the handle assembly 36*c* causes a threaded member 520 to also rotate, with a central nut 521 connected to the PCB(s) 160*c* moving linearly along the threaded member 520 as the threaded member 520 rotates, thereby moving the PCB(s) 160*c* relative to the first optic holder 162*c*, the first optic element 164*c* and the second optic element 166*c*. A post 522 can slide through a hole in the PCB(s) 160*c* to prevent the PCB(s) 160*c* from rotating with the threaded member 520.

It is also contemplated that the illustrated handle assembly 36*c* could be used only to rotate the threaded member 520, with controls for the LEDs being elsewhere (e.g., on the housing or elsewhere in an operating room). Furthermore, it is contemplated that the PCB(s) 160*c* could be moved using a slider (or other mechanical member) or could be controlled electronically instead of using the handle assembly 36*c*, with the handle assembly 36*c* being any of the handle assemblies described herein. Moreover, it is contemplated that the first optic elements 164*c* could be non-symmetric to account for the movement of the PCB(s) 160*c* with the LEDs thereon. It is further contemplated that movement of the first optic elements 164*c* and the second optic element 166*c* relative to the LEDs can cause the color of the light to alter.

Figure 18A:
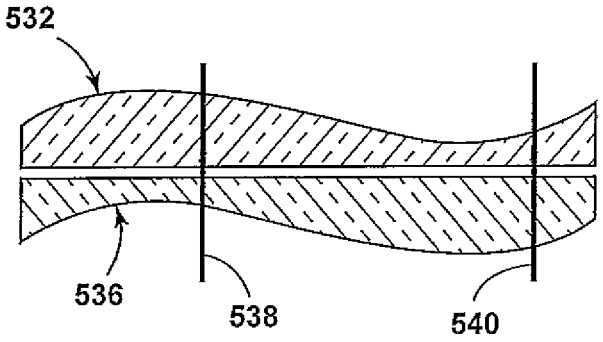
FIGS. 18A-18C are partial schematic cross-sectional views of the second optic element of the fifth embodiment of the light assembly according to the invention.
Figure 18B:
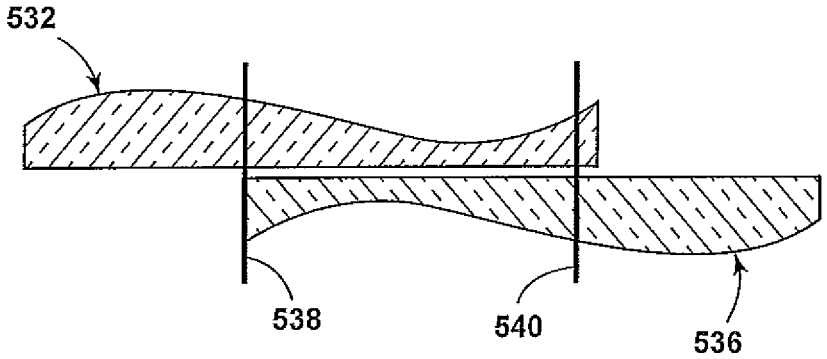
Figure 18C:
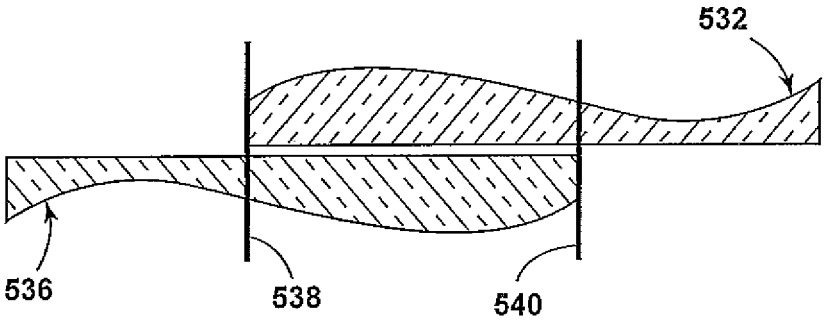

The reference numeral 12*d* (FIGS. 16-18C) generally designates fifth embodiment of the light assembly of the present invention. Since light assembly 12*d* is similar to the previously described light assembly 12, similar parts appearing in FIGS. 1-12 and FIGS. 16-18C, respectively, are represented by the same, corresponding reference number, except for the suffix "d" in the numerals of the latter. In the fifth embodiment of the light assembly 12*d*, the second optic element is replaced with a first optic disc 530 having a plurality of first Alvarez lens portions 532 and a second optic disc 534 having a plurality of second Alvarez lens portions 536 thereon. In the fifth embodiment of the light assembly 12*d*, the second optic disc 534 is configured to rotate by rotation of an inner portion 531 of the handle assembly 36*d* and the first optic disc 530 is configured to rotate relative to the second optic disc 534 by rotation of an outer portion 533 of the handle assembly 36*d*. As illustrated in FIGS. 18A-18C, the first optic disc 530 and the second optic disc 534 are located in an area above the first optic element between lines 538 and 540. Rotation of the first optic disc 530 relative to the second optic disc 534 and/or rotation of the first optic disc 530 and the second optic disc 534 relative to the area between lines 538 and 540 alter the shape of a combination lens defined by the first Alvarez lens portion 532 and the second Alvarez lens portion 536 located between the lines 538 and 540 to alter the refraction of the combination lens and/or power of the lens. Alvarez lens portions and Alvarez lenses are well known to those skilled in the art along with being disclosed in U.S. Pat. No. 3,305,294 entitled TWO-ELEMENT VARIABLE-POWER SPHERICAL LENS, the entire contents of which are hereby incorporated herein by reference.

It is also contemplated that the illustrated handle assembly 36*d* could be used only to rotate the first optic disc 530 and/or the second optic disc 534, with controls for the LEDs being elsewhere (e.g., on the housing or elsewhere in an operating room). Furthermore, it is contemplated that the first optic disc 530 and/or the second optic disc 534 could be moved using a slider (or other mechanical member) or could be controlled electronically instead of using the handle assembly 36*d*, with the handle assembly 36*d* being any of the handle assemblies described herein.

Figure 19:
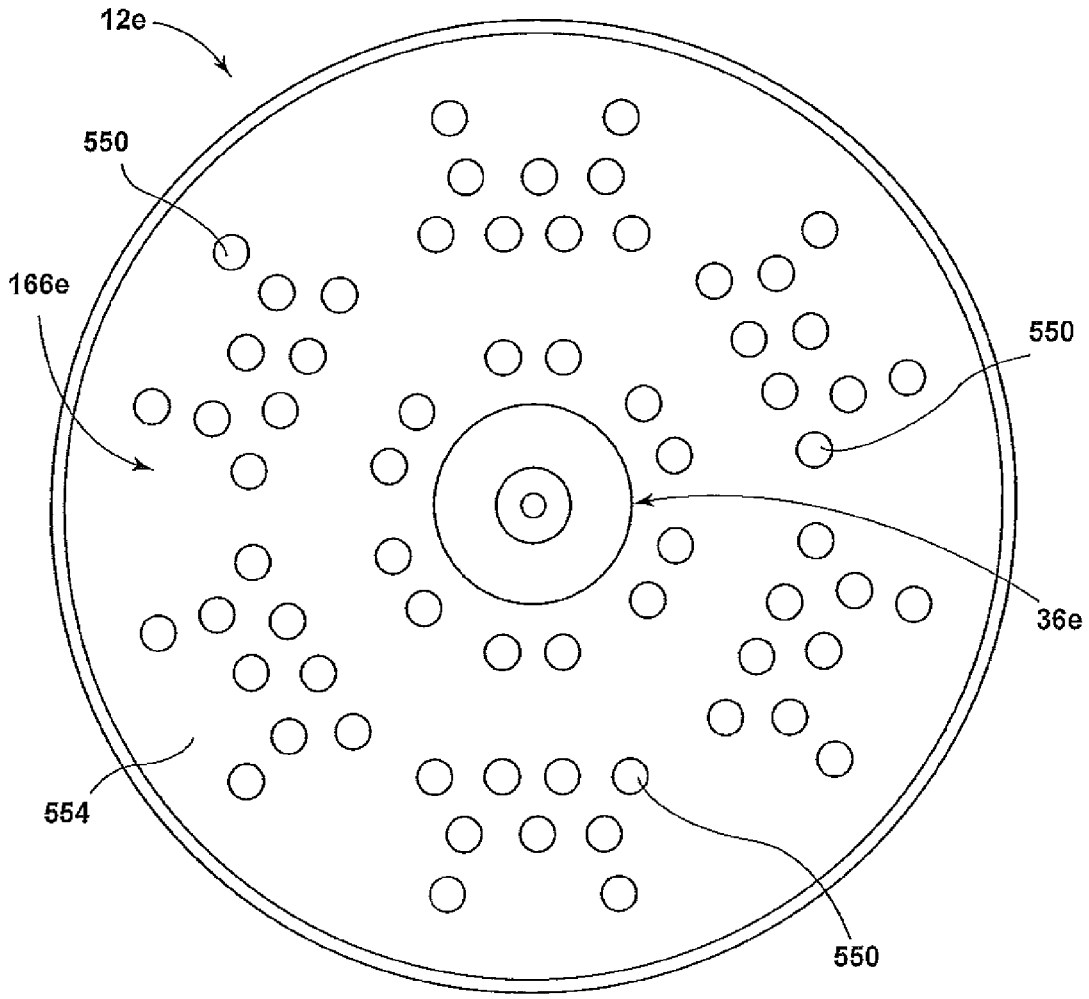
FIG. 19 is a top view of a sixth embodiment of the light assembly according to the invention.
Figure 20:
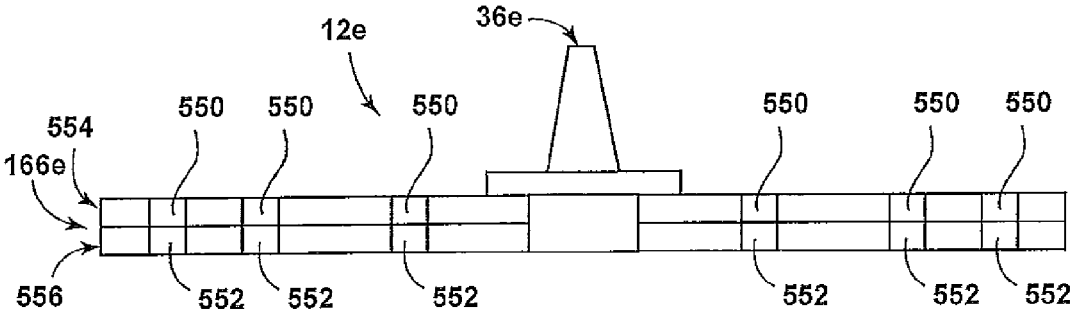
FIG. 20 is a partial schematic cross-sectional view of the sixth embodiment of the light assembly according to the invention.

The reference numeral 12*e* (FIGS. 19-20) generally designates a sixth embodiment of the light assembly of the present invention. Since light assembly 12*e* is similar to the previously described light assembly 12, similar parts appearing in FIGS. 1-12 and FIGS. 19-20, respectively, are represented by the same, corresponding reference number, except for the suffix "e" in the numerals of the latter. In the sixth embodiment of the light assembly 12*d*, the second optic element 166*e* comprises a first optic disc 554 having a plurality of first configurable lens areas 550 and a second optic disc 556 having a plurality of second configurable lens areas 552. The first configurable lens areas 550 and the second configurable lens areas 552 are aligned over the first optic elements and the LEDs. The first configurable lens areas 550 and/or the second configurable lens areas 552 can each comprise a fixed lens or a flexible membrane that uses gas or liquid to change a shape of the flexible membrane by pumping gas or fluid into or out of the first configurable lens areas 550 and the second configurable lens areas 552 to alter the refractive index and power of the first configurable lens areas 550 and the second configurable lens areas 552.

In the illustrated example, less fluid or gas causes the first configurable lens areas 550 and the second configurable lens areas 552 to bow inward due to reduced internal pressure and more fluid or gas causes the first configurable lens areas 550 and the second configurable lens areas 552 to bow outward due to increased internal pressure to alter the refractive index and power. The gas or fluid can be supplied to the first configurable lens areas 550 and the second configurable lens areas 552 from a fluid or gas reservoir located within the housing of the light system 12*e* or connected to the housing of the light system 12*e*. It is also contemplated that the illustrated handle assembly 36*e* could be any of the handle assemblies described herein.

Figure 21:
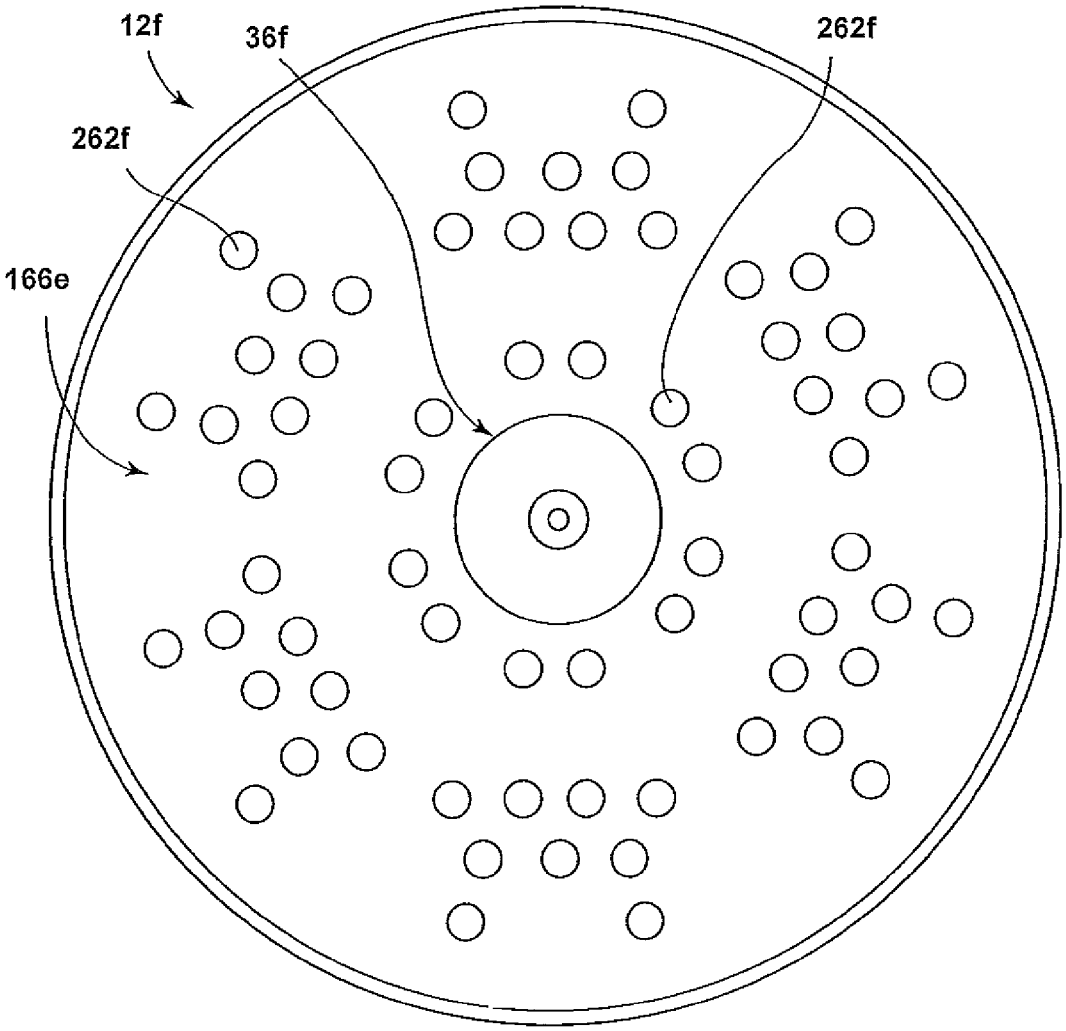
FIG. 21 is a top view of a seventh embodiment of the light assembly according to the invention.
Figure 22:
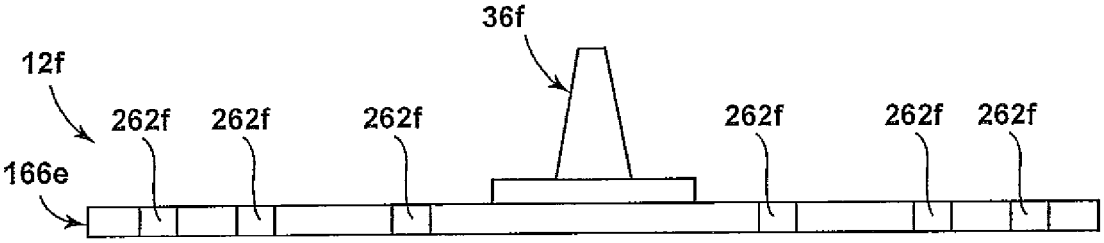
FIG. 22 is a partial schematic cross-sectional view of the seventh embodiment of the light assembly according to the invention.

The reference numeral 12*f* (FIGS. 21-22) generally designates a seventh embodiment of the light assembly of the present invention. Since light assembly 12*f* is similar to the previously described light assembly 12, similar parts appearing in FIGS. 1-12 and FIGS. 21-22, respectively, are represented by the same, corresponding reference number, except for the suffix "f" in the numerals of the latter. In the seventh embodiment of the light assembly 12*f*, the lens areas 262*f* of the second optic element 166*f* comprise electro-active lenses. The electro-active lenses can include liquid crystal displays that alter their refractive indexes and power when an electric field is applied thereacross. It is contemplated that different electric fields can be applied across the lens areas 262*f* to alter the refractive index and power. For example, the lens areas 262*f* can have a first refractive index when no field is applied thereacross and a second refractive index when the field is applied. It is also contemplated that the field can be selectively and incrementally or variably altered to cause a refractive index to vary across the entire second optic element 166*f* and or each lens area 262*f* can have a field that is selectively and incrementally or variably altered to cause a refractive index of the lens area 262*f* to change. It is also contemplated that the illustrated handle assembly 36*f* could be any of the handle assemblies described herein.

Figure 23:
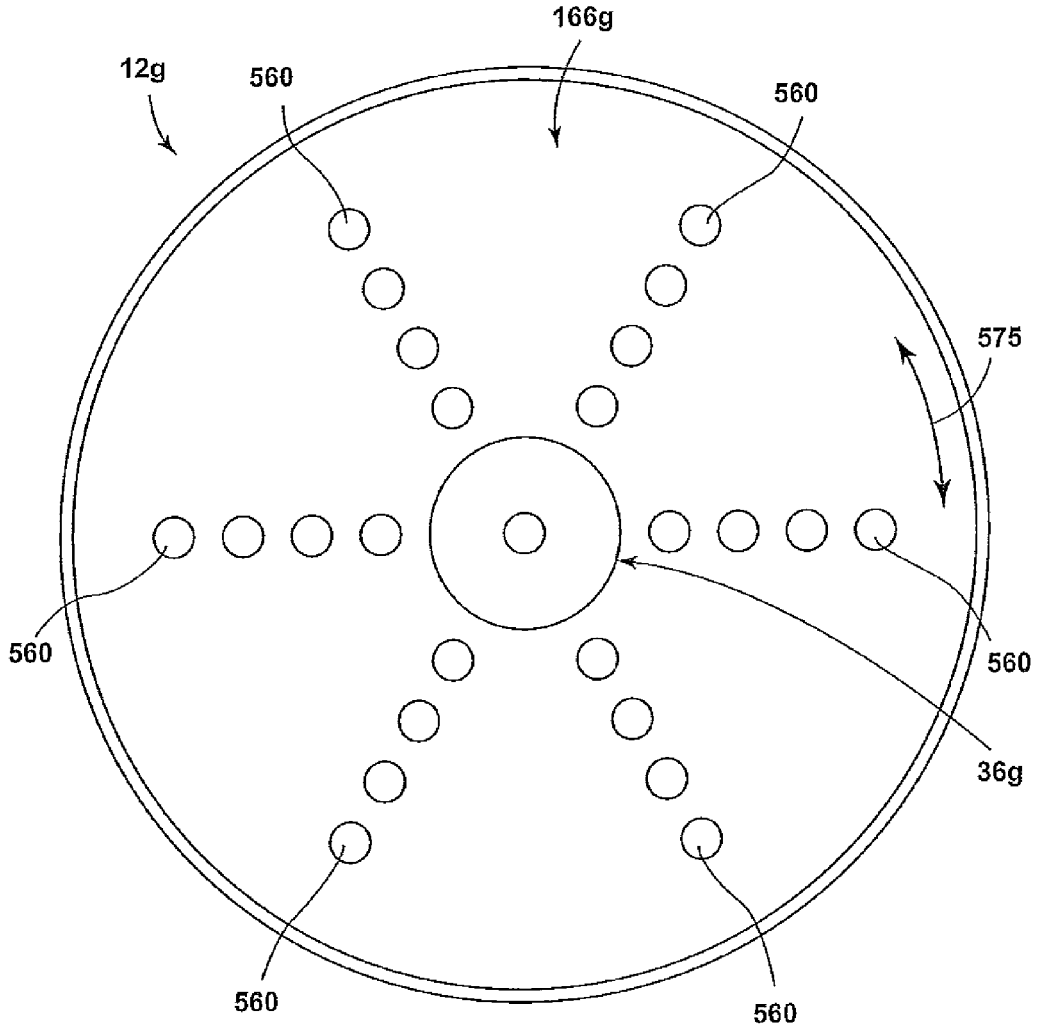
FIG. 23 is a top view of an eighth embodiment of the light assembly according to the invention.
Figure 24:
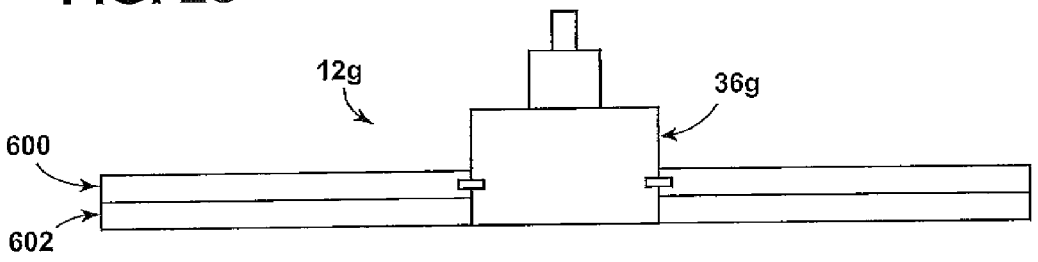
FIG. 24 is a partial schematic cross-sectional view of the eighth embodiment of the light assembly according to the invention.

The reference numeral 12*g* (FIGS. 23-24) generally designates an eight embodiment of the light assembly of the present invention. Since light assembly 12*g* is similar to the previously described light assembly 12, similar parts appearing in FIGS. 1-12 and FIGS. 23-24, respectively, are represented by the same, corresponding reference number, except for the suffix "d" in the numerals of the latter. In the eight embodiment of the light assembly 12*g*, the second optic element 166*g* includes a first fixed element 602 having the lens areas and a movable color element 602. In the illustrated embodiment, the LED, first optic elements and the lens area are radially aligned in six rows. The movable color element 602 is mostly transparent, but includes six rows of color circles 560 that can be selectively positioned over the LEDs, first optic elements and lens areas of the second optic element 166*g* to alter the color of the light emitted from the light assembly 12*g*. The color circles 560 can be moved over the LEDs, first optic elements and lens areas of the second optic element 166*g* by rotating the handle assembly 36*g*, thereby causing the movable color element 602 to rotate along line 575.

It is also contemplated that the illustrated handle assembly 36*g* could be used only to rotate the movable color element 602, with controls for the LEDs being elsewhere (e.g., on the housing or elsewhere in an operating room). Furthermore, it is contemplated that the movable color element 602 could be moved using a slider (or other mechanical member) or could be controlled electronically (e.g., using a logic controller that adjusts the movable color element 602 to achieve a predetermined color of light) instead of using the handle assembly 36*g*, with the handle assembly 36*g* being any of the handle assemblies described herein. It is also contemplated that the light assembly 12*g* could include multiple movable color elements 602 (e.g., rotatable using concentric portions of the handle assembly 36*g*, with each movable color element 602 having different colors and/or different color gradients). It is also contemplated that a single movable color element 602 could include multiple colors or color gradients. It is further contemplated that the first optic element and/or the second optic element themselves could be color in order to produce colored light (with or without further movable color element(s) positioned thereon). It is also contemplated that the movable color element 602 could be one or more separate discs that fasten over the plate glass to change the color of the light emitted from the light assembly.

The reference numeral 12*h* (FIGS. 25-26) generally designates a ninth embodiment of the light assembly of the present invention. Since light assembly 12*h* is similar to the previously described light assembly 12, similar parts appearing in FIGS. 1-12 and FIGS. 25-26, respectively, are represented by the same, corresponding reference number, except for the suffix "h" in the numerals of the latter. In the ninth embodiment of the light assembly 12*h*, the handle assembly 36*h* includes a lower stationary portion substantially identical to the lower stationary portion 276 of the handle assembly 36 of the first embodiment of the light assembly 12. However, the upper rotatable portion 278*h* has a removable cover 800 over an inner portion 802 thereof.

Figure 26:
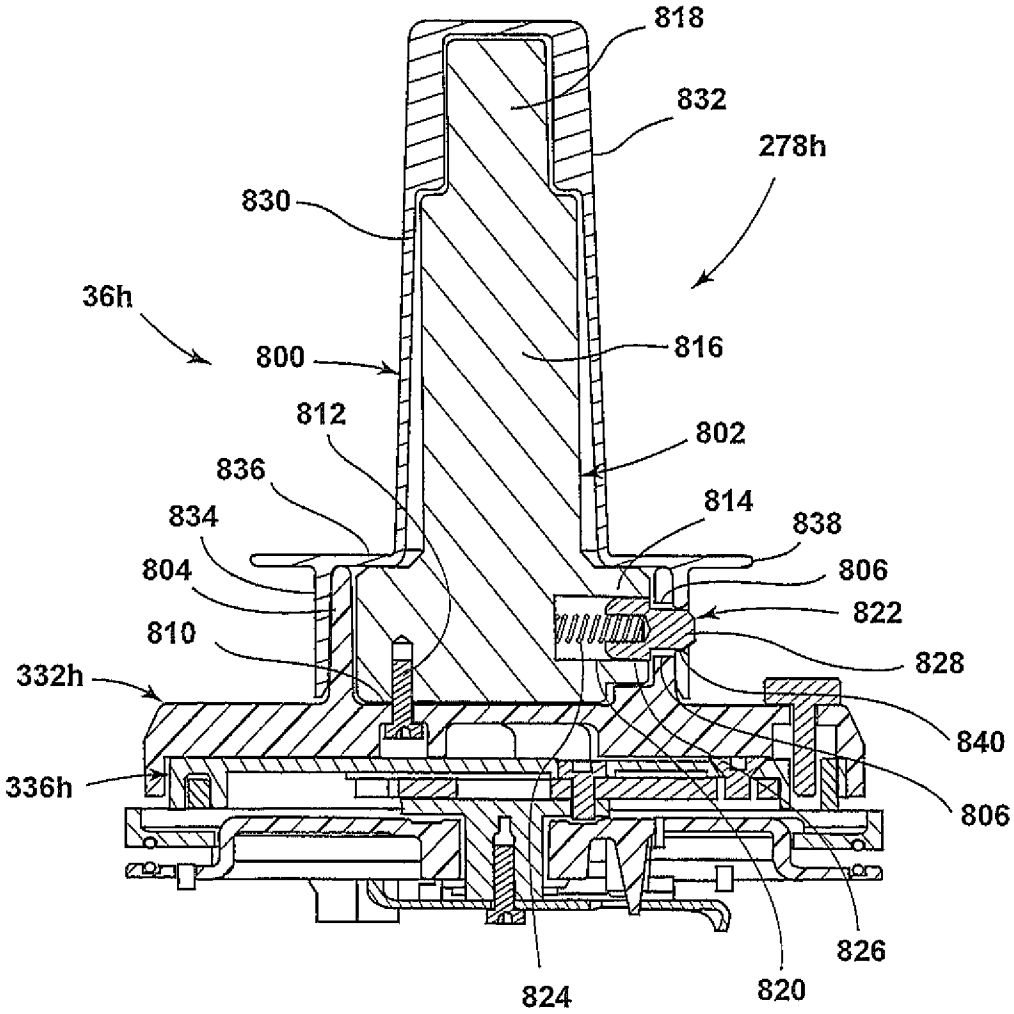
FIG. 26 is a cross-sectional side view of a handle assembly of the ninth embodiment of the light assembly according to the invention.

In the illustrated example, the inner portion 802 has a substantially circular base pedestal 332*h* and a disc seal 336*h*. The engagement of the upper rotatable portion 278*h* with the lower stationary portion of the handle assembly 36*h* can be identical to that as described above. The substantially circular base pedestal 332*h* includes an upstanding ring member 804 extending upwardly therefrom collinear with a rotational axis of the handle assembly 36*h*. The upstanding ring member 804 includes a side opening 806 therein. A stepped holding member 808 is positioned within the upstanding ring member 804 and abuts against a top surface 810 of the circular base pedestal 332*h*. As illustrated in FIG. 26, a fastener 812 extends through the circular base pedestal 332*h* and into the stepped holding member 808 to fix the stepped holding member 808 to the circular base pedestal 332*h*.

The illustrated stepped holding member 808 selectively retains the removable cover 800 to the inner portion 802 of the upper rotatable portion 278*h*. The stepped holding member 808 includes a lower portion 814 fitting closely within the upstanding ring member 804 and having about the same height, a middle tall cylinder 816 on top of the lower portion 814 and a thin top cylinder 818 on top of the middle tall cylinder 816. As illustrated in FIG. 26, a side of the lower portion 814 includes a closed bore 820 in a side thereof, with the closed bore 820 having a pressable button 822 configured to be pressure activated therein. A spring 824 biases the pressable button 822 out of the closed bore 820. The pressable button 822 has a larger inner cylinder 826 and an outer smaller cylinder 828. The closed bore 820 of the lower portion 814 of the stepped holding member 808 is aligned with the side opening 806 in the upstanding ring member 804. The larger inner cylinder 826 of the pressable button 822 fits within the closed bore 820, but is too large to pass through the side opening 806 in the upstanding ring member 804 such that the upstanding ring member 804 limits outward movement of the pressable button 822. The removable cover 800 fits over the stepped holding member 808.

In the illustrated example, the removable cover 800 includes a stepped inner recess 830 substantially corresponding to an outer surface of the thin top cylinder 818 of the stepped holding member 808, the middle tall cylinder 816 of the stepped holding member 808 and the upstanding ring member 804 such that the removable cover 800 closely receives the thin top cylinder 818, the middle tall cylinder 816 and the upstanding ring member 804 within the stepped inner recess 830. The removable cover 800 has a narrow smooth outer surface area 832 over the thin top cylinder 818 and the middle tall cylinder 816 and a wide smooth outer surface area 834 over the upstanding ring member 804, with a step 836 between the narrow smooth outer surface area 832 and the wide smooth outer surface area 834. The narrow smooth outer surface area 832 can be used to grip the handle assembly 36*h* and move the light assembly 12*h*. The step 836 along with a ring 838 extending radially from the step 836 is used as a stop when the handle assembly 36*h* is gripped. The wide smooth outer surface area 834 of the removable cover 800 includes a hole 840 configured to receive the outer smaller cylinder 828 of the pressable button 822 to lock the removable cover 800 over the stepped holding member 808. The pressable button 822 is depressed to remove the pressable button 822 from the hole 840 to allow the removable cover 800 to be removed from the stepped holding member 808. The removable cover 800 can then be cleaned and/or replaced with another removable cover 800. It is contemplated that the pressable button and associated holes could be located at other areas of the removable cover 800 to be removed from the stepped holding member 808.

Figure 13:
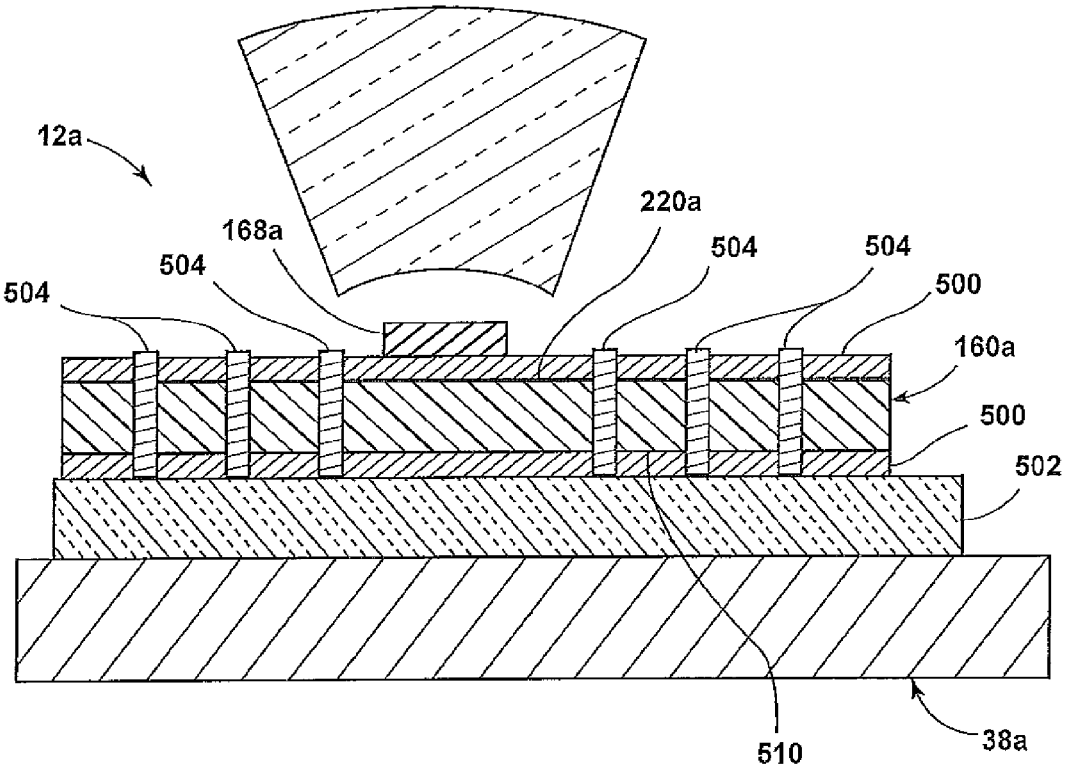
FIG. 13 is a partial schematic cross-sectional view of the support plate and lighting subassembly of a second embodiment of the light assembly according to the invention.
Figure 25:
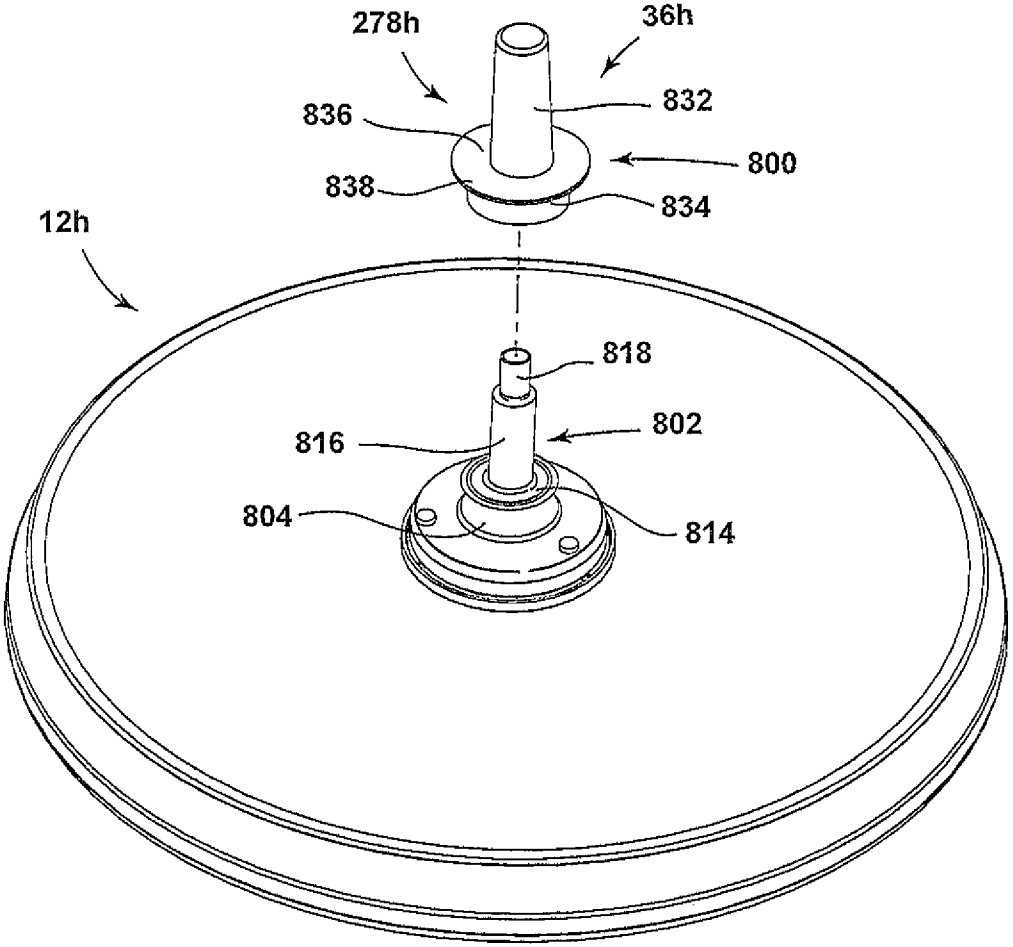
FIG. 25 is an exploded perspective view of a ninth embodiment of the light assembly according to the invention.
Figure 27:
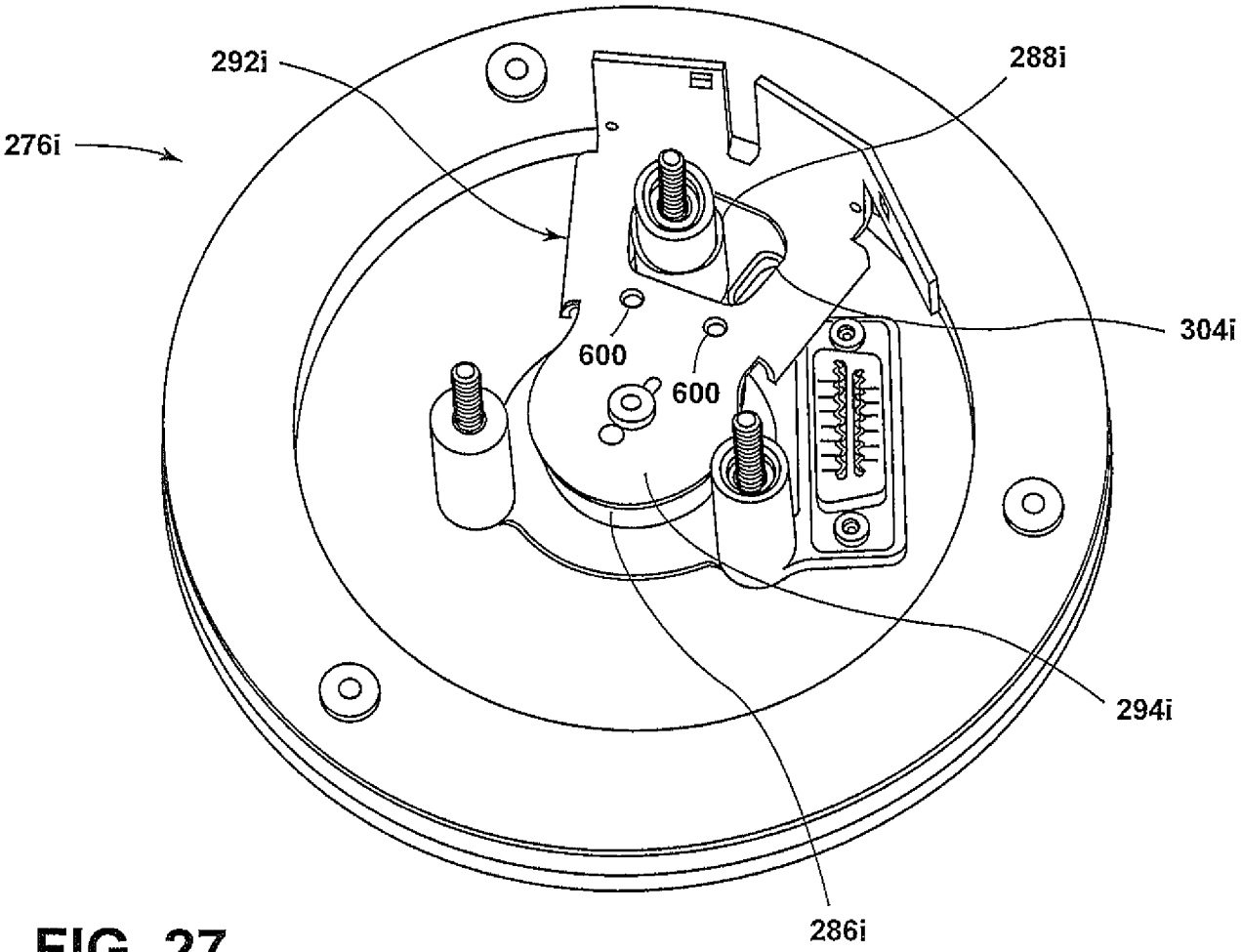
FIG. 27 is a bottom perspective view of a second embodiment of a lower stationary portion of the handle assembly of the surgical light according to the invention.

The reference numeral 276*i* (FIGS. 27-28) generally designates a second embodiment of the lower stationary portion of the handle assembly of the present invention. Since lower stationary portion 276*i* is similar to the previously described lower stationary portion 276, similar parts appearing in FIG. 12 and FIGS. 27-28, respectively, are represented by the same, corresponding reference number, except for the suffix "i" in the numerals of the latter. The second embodiment of the lower stationary portion 276*i* can be substituted for the lower stationary portion 276 described above to be used with the upper rotatable portion 278 as illustrated in FIG. 13 or the upper rotatable portion 278H as illustrated in FIGS. 25 and 26. The second embodiment of the lower stationary portion 276 does not include the springs 306, the spring support block 310 or the U-shaped spring holder 312.

Figure 28:
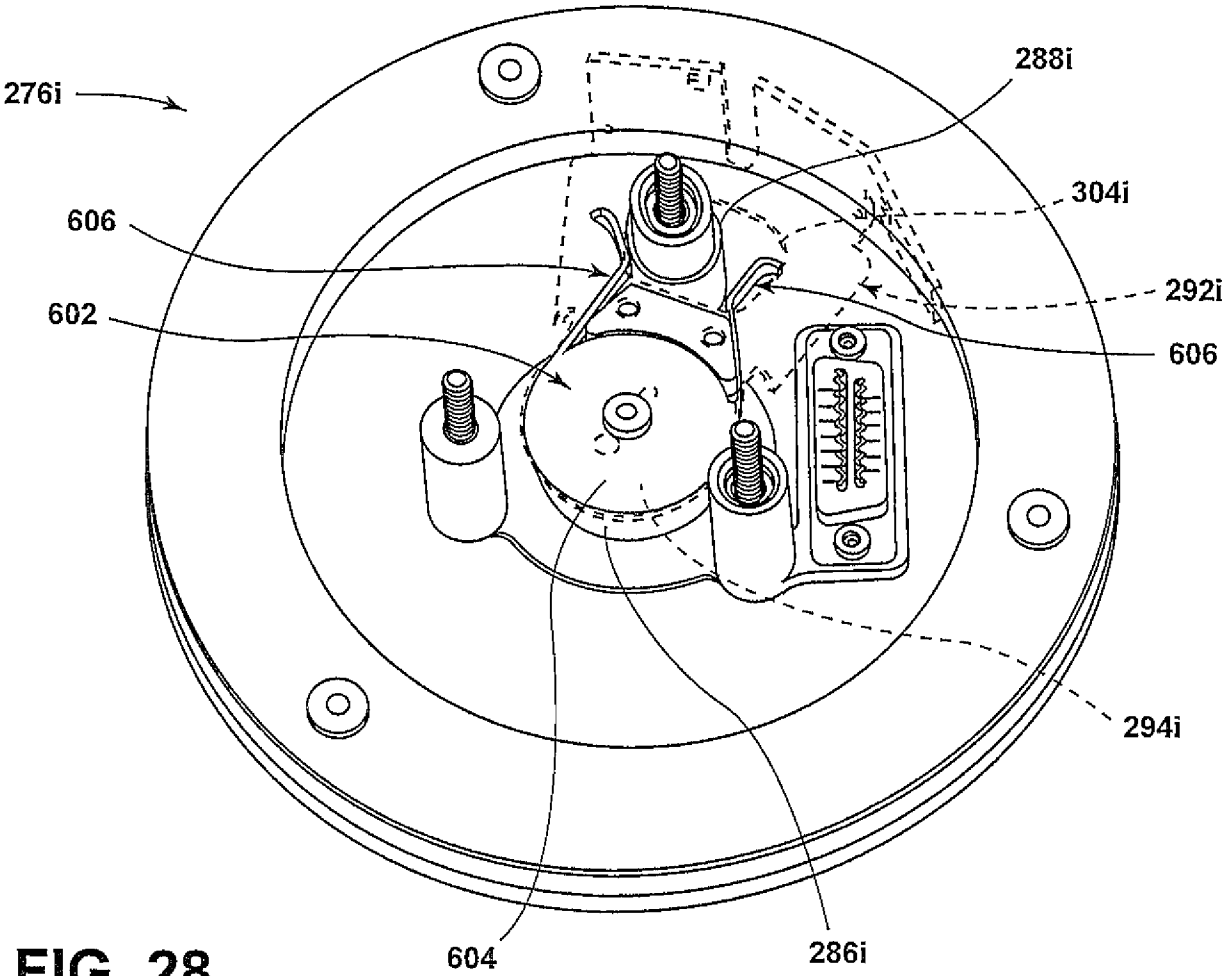
FIG. 28 is a partially broken away bottom perspective view of the second embodiment of the lower stationary portion of the handle assembly of the surgical light according to the invention.

In the illustrated embodiment, the second embodiment of the lower stationary portion 276*i* includes the switch plate 292*i*, but the switch plate 292*i* does not include the first arm 296. The second arm 300*i* includes the aperture 304*i* having the connection tube 288*i* extending therethrough. The second arm 300*i* includes a pair of openings 600 adjacent the aperture 304*i* between the aperture 304*i* and the central hub 294*i* of the switch plate 292*i*. As illustrated in FIG. 28, a U-shaped spring clip 602 is located under the switch plate 292*i*. The U-shaped spring clip 602 has a central hub 604 underneath the central hub 294*i* of the switch plate 292*i* (and captured between the enlarged ring 286*i* and the central hub 294*i* of the switch plate 292*i*) and a pair of spring arms 606. A wedge member 610 located between the connection tube 288*i* and the enlarged ring 286*i*) is connected to the second arm 300*i* by fasteners (not shown) extending through the openings 600 and into the wedge member 610. The wedge member 610 biases the spring arms 606 outward. The spring arms 606 maintain the switch plate 292*i* in a centered position when the upper rotatable portion is not forced to rotate by abutting against the connection tube 288*i* in the aperture 304*i*. The force of the spring arms 606 against the connection tube 288*i* in the aperture 304*i* will also force the switch plate 292*i* and therefor the upper rotatable portion back to a home position when the upper rotatable portion is released.

As aspect of the surgical light 10 and the light assembly 12-12*h* is to provide for a light assembly 12-12*h* that has a small or flat profile (i.e., top to bottom dimension) as the housing of the light assembly 12-12*h* does not have to be curved to allow for the LEDs to focus or redirect on a particular point. The first optical elements and the second optical elements allow the housing to have a small or flat profile (i.e., top to bottom dimension) and to direct or focus the light from the LEDs to a desired area. The first optic elements and the second optic elements allow the LEDs to all be on a planar substrate or a plurality of substantially coplanar substrates to assist in reducing the profile (i.e., top to bottom dimension) of the light assembly 12-12*h*. The second optic element can include lens areas that are all coplanar, which reduces the mechanical complexity of the light assembly and allows for the second optic element to be a single, molded part. The various features of the light assemblies 12-12*h* allow a user of the surgical light to focus or redirect the light from the LEDs at different distances, in different colors and/or with different diameters depending on the desires of the user. The various features of the light assemblies 12-12*h* also allow for the production of a less costly, less weighty, more reliable and less complex system. Moreover, allowing the second optic element to be altered, changed or substituted allows for a spot size that can be changed for a fixed spot light (i.e., light coming from the first optic elements. The vias 504 through the PCB also allow for the light assembly 12-12*h* (i.e., the vias 504 can be used in any of the light assemblies 12-12*h*) to easily dissipate the heat from the LEDs on a top surface of the PCB.

Although the present invention has been described with reference to specific exemplary embodiments, it will be recognized that the invention is not limited to the embodiments described, but can be practiced with modification and alteration within the spirit and scope of the appended claims. For example, the LEDs 168 could be another light source (e.g., incandescent bulb). Moreover, it is contemplated that a focus area or spot size could be adjusted by activating or deactivating some, but not all, of the LEDs (e.g., the LEDs that illuminate an outer perimeter of a spot when all LEDs are activated). Additionally, it is contemplated that the light assemblies 12-12*h* could be assembled by connecting adjacent elements in any order. Accordingly, the specification and drawings are to be regarded in an illustrative sense rather than a restrictive sense.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A surgical light comprising:

an arm; and a light assembly connected to the arm;

the light assembly comprising:

a housing;

a substrate positioned within the housing, the substrate having a substantially planar top surface with a plurality of LEDs on the substantially planar top surface, each of the LEDs emitting light when activated;

at least one first optical element positioned adjacent the LEDs and having a first entrance and a first exit, the at least one first optical element receiving the light emitted from the LEDs into the first entrance and passing the light therethrough, the light exiting the at least one first optical element at the first exit being collimated and substantially perpendicular to the substantially planar top surface of the substrate; and at least one second optical element positioned adjacent the first exit of the at least one first optical element, the at least one second optical element having a second entrance receiving the light exiting the at least one first optical element, the light exiting the at least one second optical element through a second exit of the at least one second optical element and focusing or redirecting on an area a desired distance from the second exit of the at least one second optical element.

2. The surgical light of claim 1, wherein:

the light assembly further includes a handle assembly, the handle assembly including a portion connected to the housing and a removable cover on the fixed portion, the portion having a pressable button configured to be actuated to allow the removable seal cover to be removed from covering the portion.

3. The surgical light of claim 2, wherein:

the handle assembly is rotated to turn the LEDs on and off.

4. The surgical light of claim 1, wherein:

the housing includes a heat sink plate located adjacent a bottom surface of the substrate, the substrate including a plurality of heat transferring conductors extending through the substrate between the substantially planar top surface and the bottom surface for transferring heat from the LEDs to the heat sink plate.

5. A surgical light comprising:

a substrate having a substantially planar top surface with a plurality of light sources on the substantially planar top surface, each of the light sources emitting light when activated; and an optical system having a first area collimating the light emitted from the light sources and a second area focusing or redirecting the light passing through the first area at a location a desired distance from the optical system.

6. The surgical light of claim 5, wherein:

the substrate and the optical system are located within a housing.

7. The surgical light of claim 6, further including:

a handle assembly including a portion connected to the housing and a removable seal cover on the portion, the fixed portion having a pressable button configured to be actuated to allow the removable seal cover to be removed from covering the portion.

8. The surgical light of claim 7, wherein:

the handle assembly is rotated to turn the light sources on and off.

9. The surgical light of claim 5, further including:

a heat sink plate located adjacent a bottom surface of the substrate, the substrate including a plurality of heat transferring vias extending through the substrate between the substantially planar top surface and the bottom surface for transferring heat from the light sources to the heat sink plate.

10. A surgical light comprising:

a housing having a plurality of lighting subassemblies therein;

each of the lighting subassemblies comprising:

a substrate having a substantially planar top surface with a plurality of light sources on the substantially planar top surface, each of the light sources emitting light when activated;

a plurality of first optical elements positioned adjacent the light sources, with each first optical element having a first entrance adjacent one of the light sources and a first exit, the plurality of first optical elements receiving the light emitted from the light sources into the first entrances and passing the light therethrough, the light exiting the plurality of first optical elements at the first exits being collimated and substantially perpendicular to the substantially planar top surface of the substrate; and a second optical element positioned adjacent the first exits of the plurality of first optical elements, the second optical element having a second entrance receiving the light exiting the plurality of first optical elements, the light exiting the second optical element through a second exit of the second optical element focusing or redirecting on a location a desired distance from the second exit of the second optical element.

11. The surgical light of claim 10, further including:

a handle assembly comprising a portion connected to the housing and a removable seal cover on the portion, the fixed portion having a pressable button configured to be actuated to allow the removable seal cover to be removed from covering the portion.

12. The surgical light of claim 11, wherein:

the handle assembly is rotated to turn the light sources on and off.

13. The surgical light of claim 10, wherein:

the housing includes a heat sink plate located adjacent a bottom surface of the substrate, the substrate including a plurality of heat transferring vias extending through the substrate between the substantially planar top surface and the bottom surface for transferring heat from the light sources to the heat sink plate.

14. A surgical light comprising:

a substrate having a substantially planar top surface with a plurality of light sources on the substantially planar top surface, each of the light sources emitting light in a cone when activated, the cone having a first spread angle; and an optical system having a first area such that the light emitted from the light sources has a second spread angle after passing through the first area and a second area focusing or redirecting the light passing through the first area at a location a desired distance from the optical system;

the second spread angle being less than the first spread angle.

15. The surgical light of claim 14, wherein:

the first area of the optical system collimates the light emitted from the light sources.

16. The surgical light of claim 14, wherein:

the first spread angle is greater than 100°; and the second spread angle is less than 80°.

17. The surgical light of claim 16, wherein:

the first spread angle is greater than 110°; and the second spread angle is less than 40°.

18. The surgical light of claim 16, wherein:

the first spread angle is greater than 110°; and the second spread angle is less than 16°.

19. The surgical light of claim 16, wherein:

the first spread angle is greater than 110°; and the second spread angle is less than 4°.

20. The surgical light of claim 16, wherein:

the second spread angle is less than 4°.

21. The surgical light of claim 20, wherein:

the light emitted from the first area of the optical system is substantially perpendicular to the planar top surface of the substrate.

* * * * *